US009116502B2

(12) United States Patent
Hayakawa et al.

(10) Patent No.: US 9,116,502 B2
(45) Date of Patent: Aug. 25, 2015

(54) IMAGE FORMING APPARATUS FOR MAINTAINING POSITIONS OF PHOTOSENSITIVE DRUMS RELATIVE TO CASING

(71) Applicants: Atsushi Hayakawa, Okazaki (JP); Naoya Kamimura, Ichinomiya (JP); Atsuhisa Nakashima, Obu (JP)

(72) Inventors: Atsushi Hayakawa, Okazaki (JP); Naoya Kamimura, Ichinomiya (JP); Atsuhisa Nakashima, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 39 days.

(21) Appl. No.: 14/032,988

(22) Filed: Sep. 20, 2013

(65) Prior Publication Data

US 2014/0093279 A1 Apr. 3, 2014

(30) Foreign Application Priority Data

Sep. 28, 2012 (JP) ..... 2012-218492

(51) Int. Cl.
*G03G 15/00* (2006.01)
*G03G 21/16* (2006.01)
*G03G 21/18* (2006.01)

(52) U.S. Cl.
CPC ..... *G03G 21/1676* (2013.01); *G03G 21/1821* (2013.01); *G03G 21/1842* (2013.01)

(58) Field of Classification Search
CPC ..... G03G 21/1842; G03G 2221/1884
USPC ..... 399/117
See application file for complete search history.

(56) References Cited

U.S. PATENT DOCUMENTS

| | | | |
|---|---|---|---|
| 3,638,112 | A | 1/1972 | Lasater et al. |
| 5,765,082 | A | 6/1998 | Numazu et al. |
| 6,708,011 | B2 | 3/2004 | Nomura et al. |
| 6,721,521 | B2 | 4/2004 | Kataoka et al. |

(Continued)

FOREIGN PATENT DOCUMENTS

| | | | |
|---|---|---|---|
| EP | 1058161 | A1 | 12/2000 |
| EP | 1816527 | A2 | 8/2007 |

(Continued)

OTHER PUBLICATIONS

Office Action Received in U.S. Appl. No. 12/606,660 mailed May 15, 2012.

(Continued)

*Primary Examiner* — Walter L Lindsay, Jr.
*Assistant Examiner* — Ruth Labombard
(74) *Attorney, Agent, or Firm* — Banner & Witcoff, Ltd.

(57) ABSTRACT

An image forming apparatus includes a cartridge and a casing. The cartridge includes a photosensitive drum, a developing roller, a developing frame, and a drum frame. The developing frame is movable between a contact position and a separated position. A separating member provided on the drum frame acts on the developing frame, so that a reaction force is exerted in a reaction force direction. The casing includes a positioning member, an urging member, and a separation pressing member. The positioning member has a first surface and a second surface. The urging member is configured to urge an end portion of the photosensitive drum toward the positioning member in an urging direction. The first surface is configured to support the end portion at a position downstream of the urging direction. The second surface is configured to support the end portion at a portion downstream of the reaction force direction.

18 Claims, 17 Drawing Sheets

(56) References Cited

U.S. PATENT DOCUMENTS

| | | | | |
|---|---|---|---|---|
| 7,706,716 | B2 | 4/2010 | Tada et al. | |
| 7,715,752 | B2 | 5/2010 | Sakurai et al. | |
| 7,826,773 | B2 | 11/2010 | Kawamura | |
| 7,899,360 | B2 | 3/2011 | Kondo et al. | |
| 7,937,020 | B2 | 5/2011 | Sakurai et al. | |
| 7,957,670 | B2 | 6/2011 | Kondo et al. | |
| 8,126,366 | B2 | 2/2012 | Hattori | |
| 2001/0019418 | A1 | 9/2001 | Kataoka et al. | |
| 2003/0161656 | A1 | 8/2003 | Miura et al. | |
| 2007/0110473 | A1 | 5/2007 | Kondo et al. | |
| 2007/0160384 | A1 | 7/2007 | Sakurai et al. | |
| 2007/0177899 | A1 | 8/2007 | Kawamura | |
| 2007/0280730 | A1 | 12/2007 | Okabe et al. | |
| 2007/0280733 | A1 | 12/2007 | Shiraki et al. | |
| 2007/0286632 | A1 | 12/2007 | Okabe | |
| 2008/0075502 | A1 | 3/2008 | Tada et al. | |
| 2008/0159774 | A1 | 7/2008 | Tanabe et al. | |
| 2009/0169247 | A1 | 7/2009 | Hattori | |
| 2010/0111562 | A1 | 5/2010 | Okabe et al. | |
| 2010/0209139 | A1 | 8/2010 | Sakurai et al. | |
| 2011/0013935 | A1 | 1/2011 | Kondo et al. | |
| 2011/0164897 | A1* | 7/2011 | Kikuchi | 399/111 |
| 2012/0114376 | A1 | 5/2012 | Kawamura | |
| 2012/0275822 | A1 | 11/2012 | Kawamura | |
| 2014/0086622 | A1 | 3/2014 | Nakashima | |

FOREIGN PATENT DOCUMENTS

| | | | |
|---|---|---|---|
| JP | 08-305184 | A | 11/1996 |
| JP | 09-281770 | A | 10/1997 |
| JP | 11-084799 | A | 3/1999 |
| JP | 2000-181329 | A | 6/2000 |
| JP | 2001-249517 | A | 9/2001 |
| JP | 2003-015378 | A | 1/2003 |
| JP | 2003-316233 | A | 11/2003 |
| JP | 2006-184901 | A | 7/2006 |
| JP | 2007-140041 | A | 6/2007 |
| JP | 2007-213023 | A | 8/2007 |
| JP | 2007-213033 | A | 8/2007 |
| JP | 2008-065122 | A | 3/2008 |
| JP | 2009-162915 | A | 7/2009 |
| JP | 2010-107890 | A | 5/2010 |
| JP | 2011-065030 | A | 3/2011 |
| JP | 2011-215406 | A | 10/2011 |

OTHER PUBLICATIONS

Office Action received in U.S. Appl. No. 12/606,660 mailed Aug. 28, 2012.

Notice of Allowance received in U.S. Appl. No. 12/606,660 mailed Jun. 28, 2013.

Office Action received in corresponding Chinese Patent Application 200910205932.9 mailed Jun. 1, 2012.

Office Action received in corresponding Chinese Patent Application 200910205932.9 mailed May 25, 2011.

Extended European Search Report for application No. 09174172.8 mailed Nov. 24, 2010.

Office Action received in corresponding Japanese Patent Application No. 2008-281992 mailed Sep. 7, 2010.

Office Action received in corresponding Japanese Patent Application No. 2008-281993 mailed Sep. 7, 2010.

Office Action received in corresponding Japanese Patent Application 2008-281991 mailed Aug. 17, 2010.

Copending U.S. Appl. No. 14/032,923, filed Sep. 20, 2013.

* cited by examiner

IMAGE FORMING APPARATUS FOR MAINTAINING POSITIONS OF PHOTOSENSITIVE DRUMS RELATIVE TO CASING

CROSS REFERENCE TO RELATED APPLICATION

This application claims priority from Japanese Patent Application No. 2012-218492 filed Sep. 28, 2012. The entire content of this priority application is incorporated herein by reference.

TECHNICAL FIELD

The present invention relates to an image-forming apparatus employing an electrophotographic system.

BACKGROUND

One electrophotographic image-forming apparatus known in the art is a printer provided with a main casing, and process cartridges that are detachably mounted in the main casing. Each process cartridge comprises a drum cartridge that retains a photosensitive drum, and a developer cartridge that retains a developing roller for supplying toner to the corresponding photosensitive drum. This type of printer has been provided with a structure for bringing the developing roller in each developing cartridge to a position adjacent to the photosensitive drum of the corresponding drum cartridge in order to supply toner to the photosensitive drum during image formation, and to separate the developing roller from the photosensitive drum out of the image formation so that toner cannot be supplied to the photosensitive drum.

One example of this type of printer that has been proposed provides the main casing with a main frame formed of sheet metal, left and right fixing members for fixing the photosensitive drums in position relative to the main frame, and separating members for placing the developing rollers in contact with the corresponding photosensitive drums and for separating the developing rollers from the corresponding photosensitive drums. Each drum cartridge is provided with a photosensitive drum having a drum shaft on its right end, and a protection part in which the left end of the photosensitive drum is inserted; and provides each developer cartridge with developing-roller bearing members in which both left and right ends of the developing roller are inserted.

SUMMARY

In the conventional printer having this construction, the left and right fixing members press against the corresponding protection part and drum shaft on each photosensitive drum in a direction obliquely downward and rearward against the main frame to fix the photosensitive drums in position relative to the main frame. When the photosensitive drums are fixed in position relative to the main frame, the separating members press against the left and right ends of the developing rollers via the developing-roller bearing members in a direction obliquely upward and forward in order to separate the developing rollers from the photosensitive drums.

However, in the conventional printer described above, the separating members separate each developing roller from the corresponding photosensitive drum by pressing against the left and right ends of the developing roller in a direction obliquely upward and forward, while the left and right fixing members press against the corresponding protection part and drum shaft in a direction obliquely downward and rearward. Consequently, when separating the developing roller from the photosensitive drum in the process cartridge of the conventional printer described above, the direction of the force applied for fixing the photosensitive drum in position (i.e., obliquely downward and rearward) is opposite the direction of the force applied for separating the developing roller from the photosensitive drum (i.e., obliquely upward and forward). As a result, image formation problems have arose in the conventional printer described above because the positions of the photosensitive drums relative to the main frame could not be maintained constant while moving the developing rollers into contact with and separating the developing rollers from the corresponding photosensitive drums.

In view of the foregoing, it is an object of the present invention to provide an image-forming apparatus capable of maintaining the positions of photosensitive drums relative to a main casing constant while moving the developing rollers into contact with and separating the developing rollers from the photosensitive drums.

In order to attain the above and other objects, the present invention provides an image forming apparatus. The image forming apparatus includes a cartridge and a casing. The cartridge includes a photosensitive drum, a developing roller, a developing frame, and a drum frame. The photosensitive drum is configured to rotate about an axis line extending in an axial direction and has an end portion in the axial direction. The developing roller is disposed in confrontation with the photosensitive drum. The developing frame rotatably supports the developing roller and is movable between a contact position where the photosensitive drum contacts the developing roller and a separated position where the photosensitive drum is separated from the developing roller. The drum frame supports the photosensitive drum. The drum frame has a separating member configured to act on the developing frame so as to dispose the developing frame at the separated position. The separating member acts on the developing frame, so that a reaction force is exerted on the separating member in a reaction force direction. The casing is configured to detachably receive the cartridge. The positioning member is configured to position the end portion of the photosensitive drum. The positioning member has a first surface and a second surface extending in a direction different from that of the first surface. The urging member is configured to urge the end portion of the photosensitive drum toward the positioning member in an urging direction. The separation pressing member is configured to press the separating member so as to let the separating member act on the developing frame. The first surface is configured to support the end portion of the photosensitive drum at a position downstream of the urging direction. The second surface is configured to support the end portion of the photosensitive drum at a position downstream of the reaction force direction.

According to another aspect, the present invention provides an image forming apparatus. The image forming apparatus includes a cartridge and a casing. The casing is configured to detachably receive the cartridge. The cartridge includes a photosensitive drum, a developing roller, and a separating member. The photosensitive drum is configured to rotate about an axis line extending in an axial direction and has an end portion in the axial direction. The developing roller is movable between a contact position in contact with the photosensitive drum and a separated position separated from the photosensitive drum. The separating member is configured to move the developing roller between the contact position and the separated position. A reaction force is exerted on the separating member in a reaction force direction when the developing roller moves. The casing includes a positioning member, an urging member, and a separation pressing member. The positioning member is configured to position the end portion of the photosensitive drum. The positioning member has a first surface and a second surface extending in a different direction from that of the first surface. The urging member is configured to urge the end portion of the photosensitive drum toward the positioning member in an urging direction. The separation pressing member is configured to press the separating member so as to let the separating member be positioned at either the contact position or the separated position. The first surface is configured to support the end portion at a position downstream of the urging direction. The second surface is configured to support the end portion at a position downstream of the reaction force direction.

BRIEF DESCRIPTION OF THE DRAWINGS

The particular features and advantages of the invention as well as other objects will became apparent from the following description taken in connection with the accompanying drawings, in which.

DETAILED DESCRIPTION

1. Overall Structure of a Printer

Figure 1:
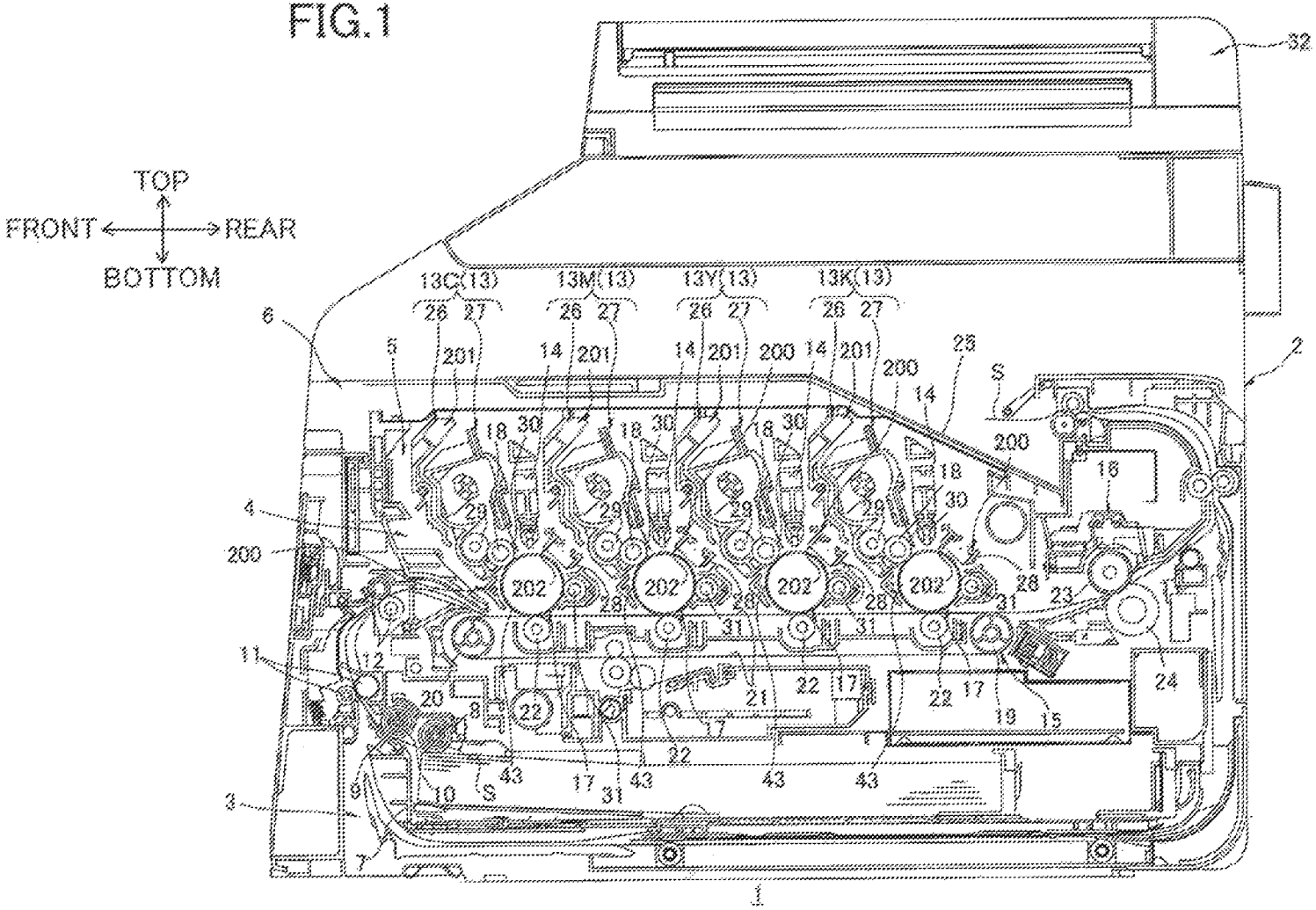
FIG. 1 is a central cross-sectional view of a printer according to illustrative aspects of an embodiment of the invention.

FIG. 1 shows a printer 1 serving as an example of the image-forming apparatus according to the present invention. The printer 1 is a direct horizontal tandem-type color printer.

The printer 1 is a multifunction peripheral integrally provided with a main casing 2, and a flatbed scanner 32 provided above the main casing 2 for reading image data from an original document.

Directions used in the following description in relation to the printer 1 will reference the state of the printer 1 when the printer 1 is resting on a level surface, where the upper side of the printer 1 in FIG. 1 is considered the "upper side", and the lower side in FIG. 1 the "lower side". Further, the left side of the printer in FIG. 1 will be called the "front", and the right side the "rear". Left and right sides of the printer 1 will be defined based on the perspective of a user facing the front of the printer 1. Thus, the far side of the printer 1 in FIG. 1 will be considered the "left side", and the near side the "right side".

Within the main casing 2, the printer 1 also includes a sheet-feeding unit 3 for feeding sheets S of a paper to be printed, and an image-forming unit 4 for forming images on the sheets S supplied by the sheet-feeding unit 3.

(1) Main Casing

The main casing 2 is formed in a box-like shape that is generally rectangular in a side view. The main casing 2 accommodates the sheet-feeding unit 3 and the image-forming unit 4. The main casing 2 has a top portion formed with an access opening 5 allowing for the mounting and removal of process cartridges 13 described laser. A top cover 6 is provided over the access opening 5 for opening and closing the same. The top cover 6 is pivotally movable about its rear edge between a closed position in which the top cover 6 covers the access opening 5 (see FIG. 1) and an open position in which the access opening 5 is exposed.

(2) Sheet-Feeding Unit

The sheet-feeding unit 3 includes a paper tray 7. The paper tray 7 is removably mounted in the bottom section of the main casing 2 and functions to accommodate sheets S.

A pickup roller 8 rotates to pick up sheets S accommodated in the paper tray 7 and to convey the sheets S out of the paper tray 7 toward a separating pad 9 and a separating roller 10. Friction produced between the separating pad 9 and the rotating separating roller 10 separate the sheets S. Subsequently, rotating conveying rollers 11 convey the separated sheets S one sheet at a time toward a pair of registration rollers 12 disposed above the conveying rollers 11. The registration rollers 12 rotate to convey the sheets S at a prescribed timing toward the image-forming unit 4 so that each sheet S passes between photosensitive drum 17 and a conveying belt 21, both described later.

(3) Image-Forming Unit

The image-forming unit 4 includes process cartridges 13, LED units 14, a transfer unit 15, and a fixing unit 16.

(3-1) Process Cartridges

Four of the process cartridges 13 are employed in the printer 1 so as to correspond to the four colors yellow, magenta, cyan, and black. The process cartridges 13 are disposed above the paper tray 7 and are arranged parallel to one another and spaced at intervals in the front-rear direction. Specifically, the process cartridges 13 are juxtaposed in the front-rear direction and include, in order from the rear side toward the front side, a black process cartridge 13K, a yellow process cartridge 13Y, a magenta process cartridge 13M, and a cyan process cartridge 13C.

Each of the process cartridges 13 is detachably is mounted in the main casing 2 and includes a drum cartridge 26, and a developer cartridge 27. The drum cartridge 26 is detachably mounted in the main casing 2 and includes the photosensitive drum 17, a scorotron charger 28, and a cleaning roller 31.

The photosensitive drums 17 have a cylindrical shape and are oriented with their axes extending in the left-right direction. The photosensitive drums 15 are rotatably supported in the drum cartridge 26.

The scorotron chargers 28 are provided obliquely above and rearward of the corresponding photosensitive drums 17 with a gap therebetween.

Four of the cleaning rollers 31 are provided to correspond to the four photosensitive drums 17. Each cleaning roller 31 is disposed beneath the corresponding scorotron charger 28 at a position for contacting the rear side of the corresponding photosensitive drum 17.

The developer cartridges 27 are detachably mounted in the corresponding drum cartridges 26. Each developer cartridge 27 is provided with a developing roller 18.

The developing roller 18 has a general columnar shape extending the the left-right direction. The developing roller 18 is disposed in the lower end of the developer cartridge 27 and is exposed outside the developer cartridge 27 through the lower rear side thereof. The developing roller 18 contacts the corresponding photosensitive drum 17 on the upper front side thereof.

Each developer cartridge 27 also includes a supply roller 29 for supplying toner to the developing roller 18, and a thickness-regulating blade 30 for regulating the thickness of toner carried on the developing roller 18. The section of the developer cartridge 27 above the supply roller 29 and the thickness-regulating blade 30 serves to accommodate toner.

(3-2) LED Units

Four of the LED units 14 are provides to correspond to the four photosensitive drums 17. Each LED unit 14 is disposed so as to face the top of the corresponding photosensitive drum 17.

(3-3) Transfer Unit

The transfer unit 15 is disposed above the paper tray 7 and below the process cartridges 13 and extends in the front-rear direction. The transfer unit 15 includes a drive roller 19, a follow roller 20, the conveying belt 21, and transfer rollers 22.

The drive roller 19 and the follow roller 20 are arranged parallel to each other and are spaced apart in the front-rear direction.

The conveying belt 21 is placed around the drive roller 19 and the follow roller 20 such that its upper portion opposes and contacts the bottom surfaces of the photosensitive drums 17.

When the drive roller 19 is driven to rotate, the conveying belt 21 circulates so that the upper portion of the conveying belt 21 in contact with the photosensitive drums 17 moves rearward.

Four of the transfer rollers 22 are provided to correspond to the four photosensitive drums 17. Each of the transfer rollers 22 confronts the corresponding photosensitive drum 17 with the upper portion of the conveying belt 21 interposed therebetween.

(3-4) Fixing Unit

The fixing unit 16 is disposed on the rear side of the transfer unit 15. The fixing unit 16 includes a heating roller 23, and a pressure roller 24 that contacts the heating roller 23 with pressure.

(4) Image-Forming Operation

Toner in each of the developer cartridges 27 is supplied onto the corresponding supply roller 29, which in turn supplies toner to the corresponding developing roller 18. The toner is positively tribocharged between the supply roller 29 and the developing roller 18. The thickness-regulating blade 30 regulates the thickness of toner supplied to the developing roller 18 as the developing roller 18 rotates, maintaining the layer of toner carried on the surface of the developing roller 18 at a thin uniform thickness.

In the meantime, the scorotron charger 28 applies a uniform charge to the circumferential surface of the photosensitive drum 17 as the photosensitive drum 17 rotates, and the LED unit 14 subsequently irradiates light onto the surface of the photosensitive drum 17 based on prescribed image data, forming an electrostatic latent image on the surface of the photosensitive drum 17. Next, the toner carried on the surface of the developing roller 18 is supplied to the electrostatic latent image formed on the surface of the photosensitive drum 17, developing the latent image into a toner image.

At the same time, a sheet S supplied from the sheet-feeding unit 3 onto the upper portion of the conveying belt 21 is conveyed rearward by the conveying belt 21. The toner images of all four colors are sequentially transferred onto the sheet S as the sheet S passes between each photosensitive drum 17 and its corresponding transfer roller 22 (transfer position) to form a color image on the sheet S.

After the toner images (color image) are transferred from the peripheral surfaces of all photosensitive drums 17 to the sheet S, the sheet S is conveyed, between the heating roller 23 and the pressure roller 24. The color image on the sheet S is fixed to the sheet S by heat and pressure as the sheet S passes between the heating roller 23 and the pressure roller 24. Through this process, the color image transferred onto the sheet S is fixed to the sheet S.

Thereafter, the sheet S is conveyed along a U-shaped path that curves upward and forward and is discharged onto a discharge bay 25 provided on the top cover 6.

2. Process Cartridges

In the following description related to the process cartridge 13, the side of the process cartridge 13 on which the photosensitive drum 17 is provided will be called the "rear side," and the side on which the scorotron charger 28 is provided will be called the "upper side." Hence, vertical and front-rear directions related to the process cartridge 13 differ from the vertical and front-rear directions related to the printer 1. More specifically, the process cartridge 13 is mounted in the printer 1 such that its front side corresponds to the upper front side of the printer 1, its rear side corresponds to the lower rear side of the printer 1, its upper side corresponds to the upper rear side of the printer 1, and its lower side corresponds to the lower front side of the printer 1.

(1) Drum Cartridges

Figure 2:
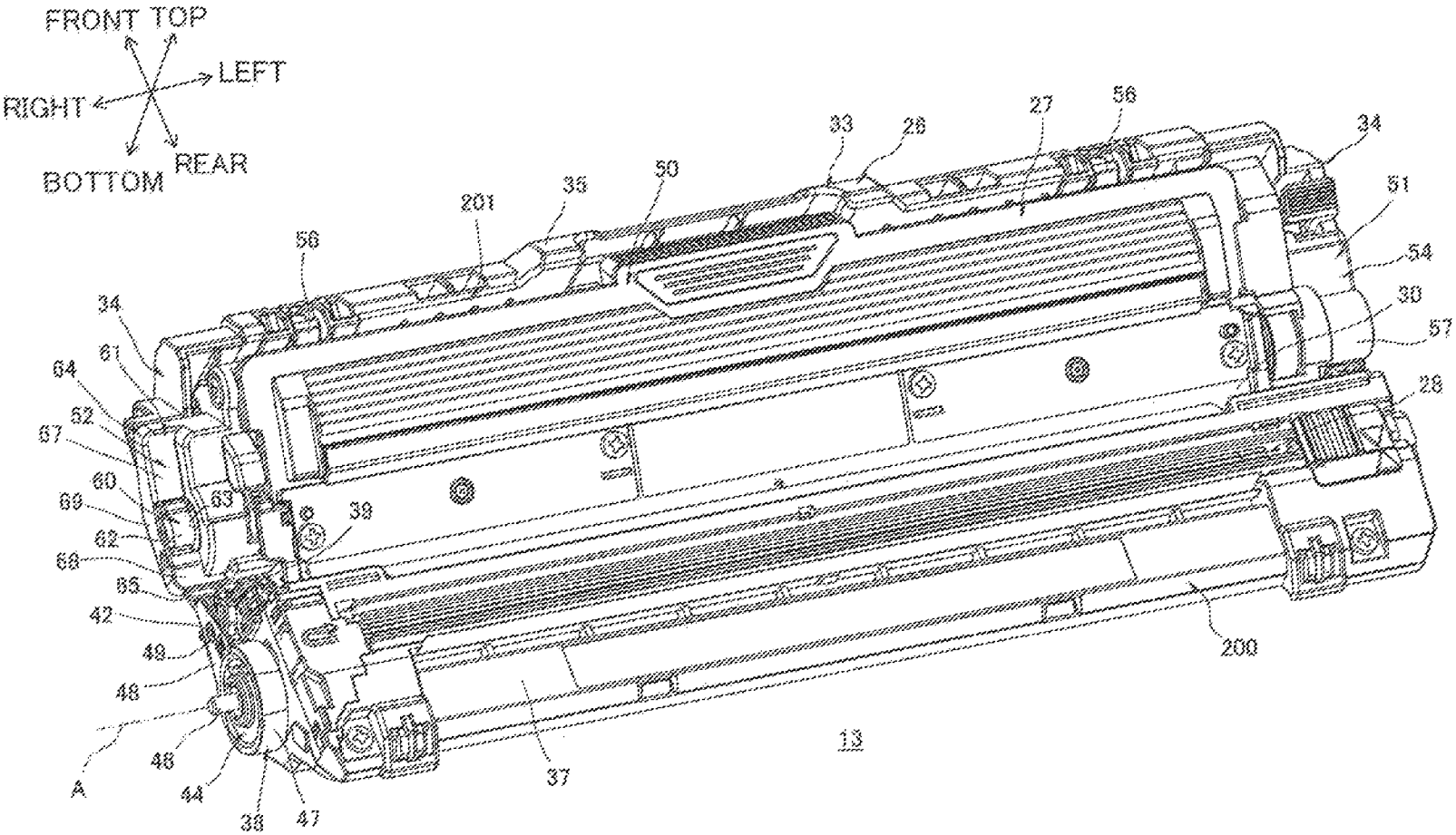
FIG. 2 is a perspective view of a process cartridge shown in FIG. 1 as viewed from diagonally rightward and rearward.

As shown in FIGS. 2 and 3, each drum cartridge 26 has a drum-cartridge frame 33.

(1-1) Drum-Cartridge Frame

As shown in FIG. 2, the drum-cartridge frame 33 has a frame-like shape with a closed bottom and is generally rectangular in a plan view. The drum-cartridge frame 33 is configured of a pair of left and right side walls 34, a front wall 35, a bottom wait 36 (see FIG. 3), and a top wall 37.

Figure 3A:
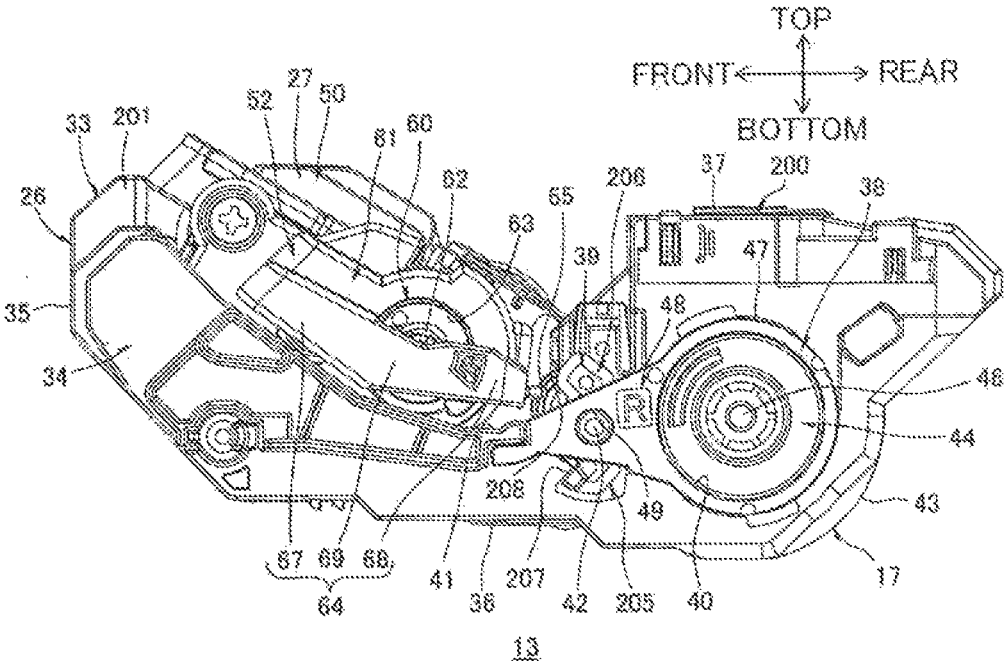
FIG. 3A is a right side view of the process cartridge shown in FIG. 2.
Figure 3B:
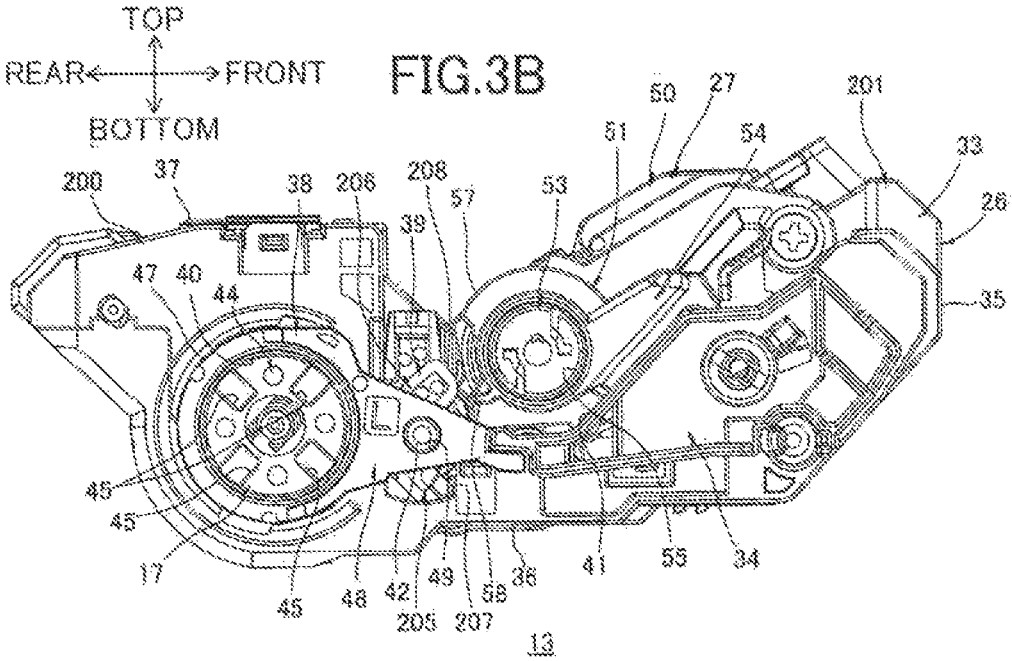
FIG. 3B is a left side view of the process cartridge shown in FIG. 2.

The side walls 34 are arranged parallel to each other and spaced apart in the left-right direction. As shown in FIGS. 3A and 3B, the side walls 34 are generally rectangular in a side view and elongated in the front-rear direction. Each side wall 114 is formed with a flange insertion hole 40 and an exposing groove 41.

The flange insertion hole 40 has a general circular shape in a side view. The flange insertion hole 40 is formed in the rear end of the side wall 34 and penetrates the side wall 34 in the left-right direction. The diameter of the flange insertion hole 40 is approximately equal to the outer diameter of a flange member 44 described later.

The exposing groove 41 is formed in the front portion of the side wall 34. The exposing groove 41 has a general V-shape in a side view and is cut out from the upper edge thereof.

Each side wall 34 is provided with a support shaft 42 disposed forward of the corresponding flange insertion holes 40 and obliquely downward and rearward from the corresponding exposing grooves 41. The support shafts 42 have a general columnar shape and extend outward in the left-right direction from the respective outer left-right surfaces of the side walls 34 (see FIG. 2).

As shown in FIG. 2, the front wall 35 has a generally flat plate shape that expands in vertical and left-right directions. The front wall 35 bridges the front ends of the side walls 34.

As shown in FIGS. 3A and 3B, the bottom wall 36 has a generally flat plate shape that expands in the front-rear and left-right directions. The bottom wall 36 bridges the lower edges of the side walls 34. The front edge of the bottom wall 36 is formed continuously with the bottom edge of the front wall 35.

As shown in FIG. 2, the top wall 37 has a generally flat plate shape that expands in the front-rear and left-right directions. The top wall 37 bridges the upper edges of the side walls 34 at the rear ends thereof so as to cover the top of the corresponding photosensitive drum 17. The corresponding scorotron charger 28 is supported on the top wall 37.

The rear portion of the drum-cartridge frame 33 constitutes a drum-accommodating section 200, while the front portion constitutes a develop-cartridge-accommodating section 201.

(1-2) Drum-Accommodating Section

The drum-accommodating section 200 is defined by the rear portions of the side walls 34, the rear portion of the bottom wall 36 (see FIGS. 3A and 3B), and the top wall 37. The drum-accommodating section 200 has a box-like shape that is open on both front and rear sides. The drum-accommodating section 200 is provided with the photosensitive drum 17 and bearing members 38.

As shown in FIGS. 3A and 3B, each photosensitive drum 17 is configured of a drum body 43, and a pair of left and right flange members 44.

The drum body 43 is formed of metal in a general cylindrical shape and is oriented with its axis in the left-right direction. The outer circumferential surface of the drum body 43 is coated with a photosensitive layer made of resin.

The flange members 44 have a general columnar shape extending in the left-right direction. As shown in FIG. 3B, the left flange member 44 is fitted into the left end of the drum body 43 so as to be incapable of rotating relative to the drum body 43. Further, a plurality of coupling fitting parts 45 is formed in the left surface of the left flange member 44.

More specifically, four of the coupling fitting parts 45 are formed in the left surface of the left flange member 44 around the outer circumference thereof at intervals of 90 degrees in the circumferential direction. The coupling fitting parts 45 are formed as recesses depressed from the left surface of the left flange member 44 and are generally rectangular in a side view. The distal end of a body-side drum coupling (not shown) provided in the main casing 2 is inserted into the coupling fitting parts 45 when the process cartridge 13 is mounted in the main casing 2 so as to be incapable of rotating relative to the left flange member 44. A rotational drive force is inputted into the coupling fitting parts 45 via the body-side drum coupling.

As shown in FIG. 3A, the right flange member 44 is fitted into the right end of the drum body 43 so as to be incapable of rotating relative thereto. Further, a shaft 46 is supported in the right flange member 44.

As shown in FIG. 2, the shaft 46 has a general columnar shape and is oriented in the left-right direction. The shaft 46 passes through the radial center of the right flange member 44 in the left-right direction. The right end of the shaft 46 protrudes rightward from the right surface of the right flange member 44.

The photosensitive drum 17 is disposed inside the drum-accommodating section 200 with the left and right flange members 44 inserted into the flange insertion holes 40 formed in the corresponding side walls 34. In this state, the left and right flange members 44 pass through the flange insertion holes 40 and protrude outward in corresponding left and right directions from the side walls 34.

As shown in FIGS. 3A and 3B, one bearing member 38 is disposed in the rear portion of each side wall 34 on the outer left-right side thereof. Each bearing member 38 is integrally configured of a shaft-receiving part 47, and a shaft-engaging part 48.

The shaft-receiving 47 has a general cylindrical shape extending in the left-right direction. The inner diameter of the shaft-receiving part 47 is approximately equal to the outer diameter of the flange member 44.

The shaft-engaging part 48 has a generally flat plate shape that is substantially triangular in a side view and protrudes forward from the front side of the shaft-receiving part 47 on the outer left-right end thereof. The shaft-engaging part 48 is formed with a fitting hole 49.

The fitting hole 49 has a general circular shape in a side view and penetrates the approximate front-rear center portion of the shaft-engaging part 48. The diameter of the fitting hole 49 is approximately equal to the outer diameter of the support shaft 42.

The bearing member 38 is fixed to the outer left-right surface of the corresponding side wall 34 such that the shaft-receiving part 47 is fitted around (fitted over the radial outside of) the corresponding flange member 44 so as to be capable of rotating relative to the flange member 44, and the fitting hole 49 is unrotatably fitted around (fitted over the radial outside of) the outer left-right end of the corresponding support shaft 42. With this configuration, the photosensitive drum 17 is rotatably supported in the drum-cartridge frame 33 through the bearing members 38. Accordingly, when a drive force is inputted into the coupling fitting parts 45, the photosensitive drum 17 rotates about an axis A extending in the left-right direction, as shown in FIG. 2.

(1-3) Developer-Cartridge-Accommodating Section

The developer-cartridge-accommodating section 201 is specifically defined by the front portions of both side walls 34, the front portion of the bottom wall 36, and the front wall 35. The developer-cartridge-accommodating section 201 has a box-like shape that is open on the top for allowing the corresponding developer cartridge 27 to the detachably mounted therein.

The drum-accommodating section 200 and the developer-cartridge-accommodating section 201 are in communication with each other through a cartridge opening 202 (see FIG. 1). The cartridge opening 202 is defined by the front portion of the front wall 35, the top surface of the bottom wall 36, and the inner left-right side surfaces of the respective side walls 34 (see FIG. 1).

The developer-cartridge-accommodating section 201 is further provided with separating members 39 (see FIG. 3), and pressing members 56 (see FIG. 2).

Figure 8:
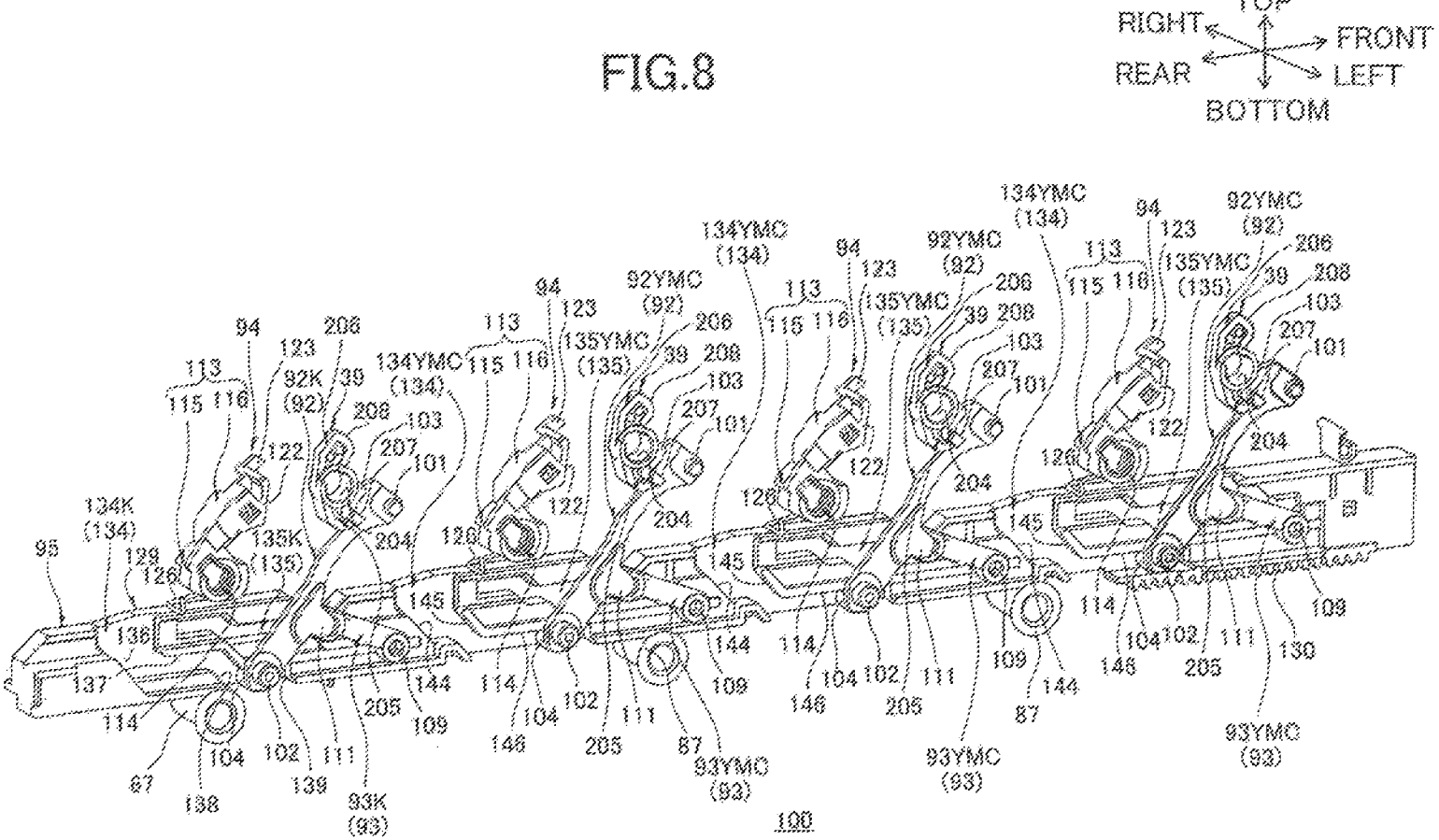
FIG. 8 is a perspective view of the contact/separation locking mechanism as viewed from diagonally leftward and rearward.

One of the separating members 39 is disposed on the left-right outside of each side wall 34 at a position forward of the flange insertion hole 40 and rearward of the exposing groove 41. As shown in FIG. 8, the separating members 39 have a generally flat plate shape that is substantially V-shaped in a side view with the opening of the "V" facing forward. Each separating member 39 is integrally configured of a shaft insertion part 204, a lower fin 205, and an upper fin 206.

The shaft insertion part 204 has a general cylindrical shape that is extending in the left-right direction. The inner diameter of the shaft insertion part 204 is approximately equal to the outer diameter of the support shaft 42.

The lower fin 205 has a generally flat plate shape that extends downward from the bottom end of the shaft insertion part 204. The lower portion of the lower fin 205 curves forward. The front surface on the lower portion of the lower fin 205 defines a pressure-receiving surface 207. The pressure-receiving surface 207 receives pressure from a contact/separation lever 92 (described later) when a developer-cartridge frame 50 (described later) is disposed in a separated position (described later).

The upper fin 206 has a generally flat plate shape that extends upward from the top end of the shaft insertion part 204. The upper portion of the upper fin 206 curves forward. The front surface on the upper portion of the upper fin 206 defines a contact surface 208. The contact surface 208 contacts either a separation contact part 58 (described later) or a separation contact part 65 (described later) when the developer-cartridge frame 50 is in the separated position, as will be described later.

As shown in FIG. 2, the separating members 39 are respectively disposed between each side wall 34 and corresponding shaft-engaging part 48. As shown in FIGS. 3A and 3B, each separating member 39 is rotatably supported on the corresponding support shaft 42 by inserting the support shaft 42 into the shaft insertion part 204.

As shown in FIG. 2, the pressing members 56 are embedded in the rear surface of the front wall 35 and positioned at the left and right ends thereof. The pressing members 56 are slidably supported on the front wall 35 so as to be capable of sliding along the front-rear direction. The pressing members 56 have a generally square cylindrical shape elongated in the front-rear direction. A compression coil spring (not shown) is accommodated or the cylindrical space within each pressing member 56 and is capable of expanding and retracting along the direction in which the pressing members 56 slide (front-rear direction). The compression coil springs constantly urge the corresponding pressing members 56 rearward.

(2) Developer Cartridges

Each developer cartridge 27 has the developer-cartridge frame 50, a drive unit 51, and a power-supply unit 52.

The developer-cartridge frame 50 has a box-like shape extending in the left-right direction. The developer-cartridge frame 50 is open on its rear side. The developer-cartridge frame 50 accommodates therein a corresponding developing roller 18 (see FIG. 1) and toner. The developing roller 18 is rotatably supported in the rear end of the developer-cartridge (frame 50 (see FIG. 1) and is exposed on the rear side thereof.

As shown in FIG. 2, the drive unit 51 is disposed on the left side of the developer-cartridge frame 50. As shown in FIG. 3B, the drive unit 51 includes a development coupling 53, and a drive-side cover 54.

The development coupling 53 has a general columnar shape extending in the left-right direction. The development coupling 53 is rotatably accommodated inside the drive-side cover 54. A coupling recession 55 is formed in the left endface of the development coupling 53.

The coupling recession 55 is recessed from the left endface of the development coupling 53. When the developer cartridge 27 is mounted in the main casing 2, the distal end of the corresponding body-side development coupling (not shown) provided in the main casing 2 is inserted into the coupling recession 55 so as to be incapable of rotating relative to the development coupling 53. A rotational drive force from the main casing 2 is inputted into the coupling recession 55 via the body-side development coupling. The rotational drive force inputted into the development coupling 53 is then transmitted to the developing roller 18 and the supply roller 29 via a gear train (not shown).

As shown in FIGS. 2 and 3B, the drive-side cover 54 has a generally square cylindrical shape extending in the left-right direction and closed on the left end thereof. The drive-side cover 54 includes a coupling collar 57, and the separation contact part 38.

The coupling collar 57 has a general cylindrical shape and protrudes leftward from the left wall of the drive-side cover 54 at the approximate front-rear center thereof. The right end of the coupling collar 57 is in communication with the interior of the drive-side cover 54.

As shown in FIG. 3B, the separation contact part 58 has a ridge-like shape extending in the left-right direction and protruding rearward from the rear edge of the coupling collar 57.

The drive-side cover 54 is fastened to the left wall of the developer-cartridge frame 50 with screws such that the left end of the development coupling 53 is fitted into the coupling collar 57. The coupling recession 55 is exposed through the left end of the coupling collar 57.

As shown is FIGS. 2 and 3A, the power-supply unit 52 is disposed on the right side of the developer-cartridge frame 50. The power-supply unit 52 includes an electrode member 60, and a supply-side cover 61.

The electrode member 60 is formed of an electrically conductive resin material, such as a conductive polyacetal resin. The electrode member 60 is supported on the right wall of the developer-cartridge frame 50 inside the supply-side cover 61. The corresponding developing roller 18 and the supply roller 29 are electrically connected to the electrode member 60. The electrode member 60 includes a power-receiving part 62.

The power-receiving part 62 has a general cylindrical shape that extends in the left-right direction. The power-receiving part 62 is in electrical contact with a body-side electrode (not shown) provided in the main casing 2 when the developer cartridge 27 is mounted in the main casing 2, enabling power to be supplied from the body-side electrode to the power-receiving part 62. Power supplied to the power-receiving part 62 (an electrical bias) is applied to both the developing roller 18 and the supply roller 29 through the electrode member 60.

The supply-side cover 61 has a general cylindrical shape extending in the left-right direction and is closed on the right end thereof. The supply-side cover 61 includes a power-receiving-part exposing hole 63, a power-receiving-part protection part 64, and the separation contact part 65.

The power-receiving-part exposing hole 63 is generally circular in a side view and penetrates the right wall of the supply-side cover 61 at the approximate front-rear center thereof for exposing the right end of the power-receiving part 62.

The power-receiving-part protection part 64 is integrally configured of a front protection part 67, a rear protection part 68, and a right protection part 69.

The front protection part 67 has a generally square columnar shape and protrudes rightward from the front peripheral edge of the power-receiving-part exposing hole 63.

The rear protection part 68 has a generally square columnar shape and protrudes rightward from the rear peripheral edge of the power-receiving-part exposing hole 63.

The right protection part 69 has a generally flat plate shape extending in the front-rear direction for bridging the right ends of the front protection part 67 and the rear protection part 68. The right protection part 69 opposes the right endface of the power-receiving part 62 from the right side.

The separation contact part 65 has a ridge-like shape extending in the left-right direction and protrudes rearward from the rear end of the rear protection part 68.

The supply-side cover 61 is fixed to the right side wall 34 with screws such that the right end of the power-receiving part 62 is exposed through the gap between the front protection part 67 and the rear protection part 68.

(3) Mounting Developer Cartridge in Drum Cartridge

The developer cartridge 27 is mounted in the developer-cartridge-accommodating section 201 of the corresponding drum-cartridge frame 33. Through this construction, the developer cartridge 27 is accommodated in the drum cartridge 26 and together with the drum cartridge 26 forms the process cartridge 13.

When the developer cartridge 27 is mounted in the developer-cartridge-accommodating section 201, the separation contact part 58 of the power-supply unit 52 and the separation contact part 65 of the drive unit 51 are positioned outside the respective side walls 34 in the left-right direction through the exposing grooves 41. The separation contact part 58 and the separation contact part 65 are positioned on the front sides of the corresponding separating members 39 and are separated therefrom.

As shown in FIG. 2, the pressing members 56 contact the left and right ends on the front wall of the developer-cartridge frame 50 to press the developer cartridge 27 rearward. Consequently, the developer-cartridge frame 50 is normally disposed in a contact position in which the developing roller 18 and the photosensitive drum 17 oppose and contact with each other through the cartridge opening 202 (see FIG. 12).

However, as will be described later in greater detail, when the separating members 39 press against the corresponding separation contact part 58 and separation contact part 65 (see the process cartridges 13YMC in FIG. 15), the developer-cartridge frame 50 moves obliquely upward and forward relative to the drum-cartridge frame 33 and against the urging force of the pressing members 56. As a result, the developer-cartridge frame 50 is placed in the separated position in which the developing roller 18 is separated from the photosensitive drum 17. Hence, the developer-cartridge frame 50 can be moved between the contact position and the separated position.

3. Main Casing (1) Main Side Walls

Figure 4:
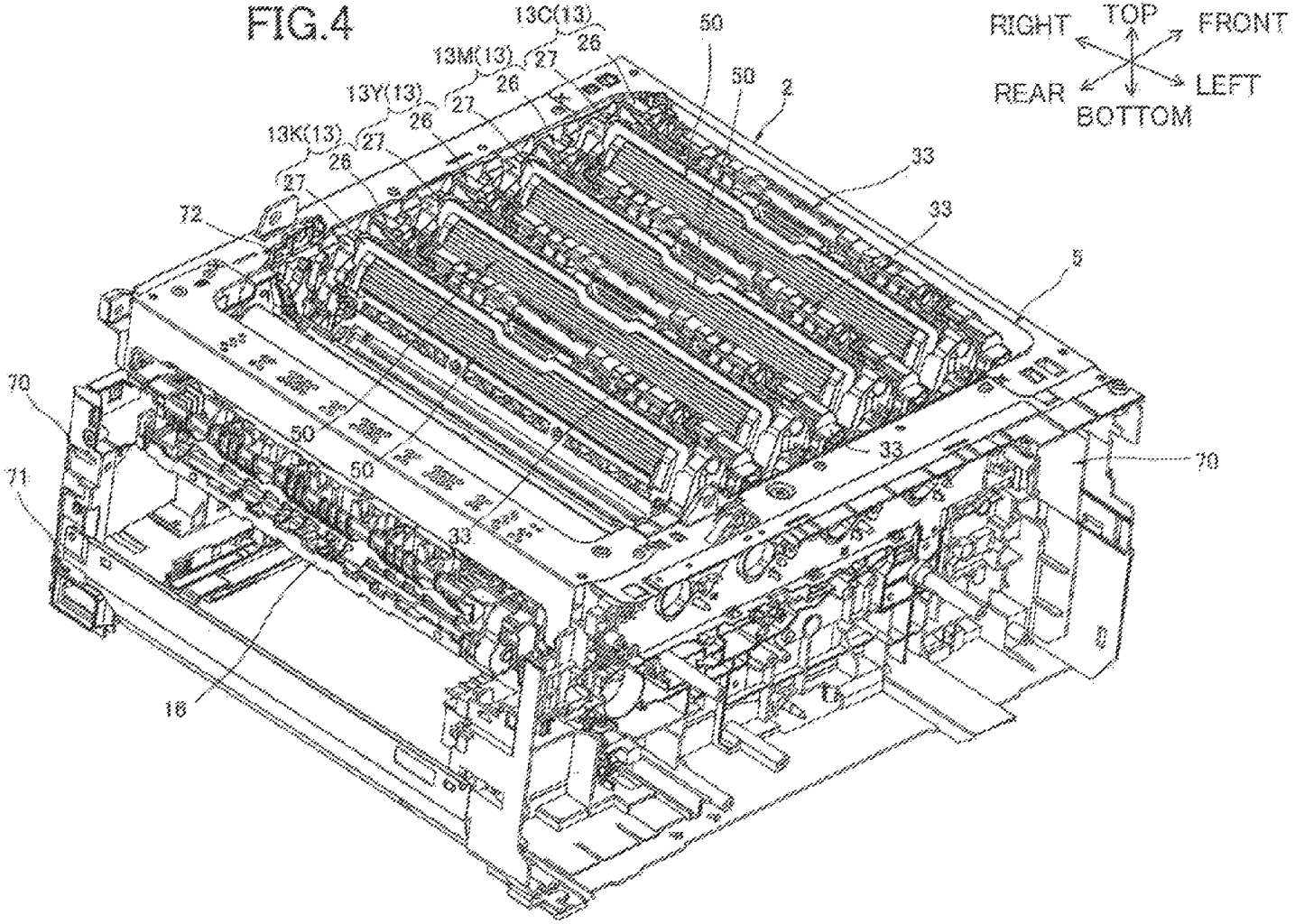
FIG. 4 is a perspective view of a main casing of the printer as viewed from diagonally leftward and rearward.

As shown in FIG. 4, the main casing 2 has a pair of main side walls 70. The main side walls 70 are arranged parallel to each other and spaced apart in the left-right direction so that one main side wall 70 is disposed on the outside of each of the left and right ends of the process cartridges 13. In the preferred embodiment, the structure related to contact/separation levers 92, linking members 93, and a translation cam 95 each provided in the contact/separation locking mechanism 100 described later is provided on each of the main side walls 70 so as to have a symmetrical shape and layout in the left-right direction. Since the structures of the contact/separation locking mechanism 100 are identical, though symmetrical, the following description will focus on the right main side wall 70 and not the left main side wall 70, but will refer to the right main side wall 70 as simply the main side wall 70.

Figure 5:
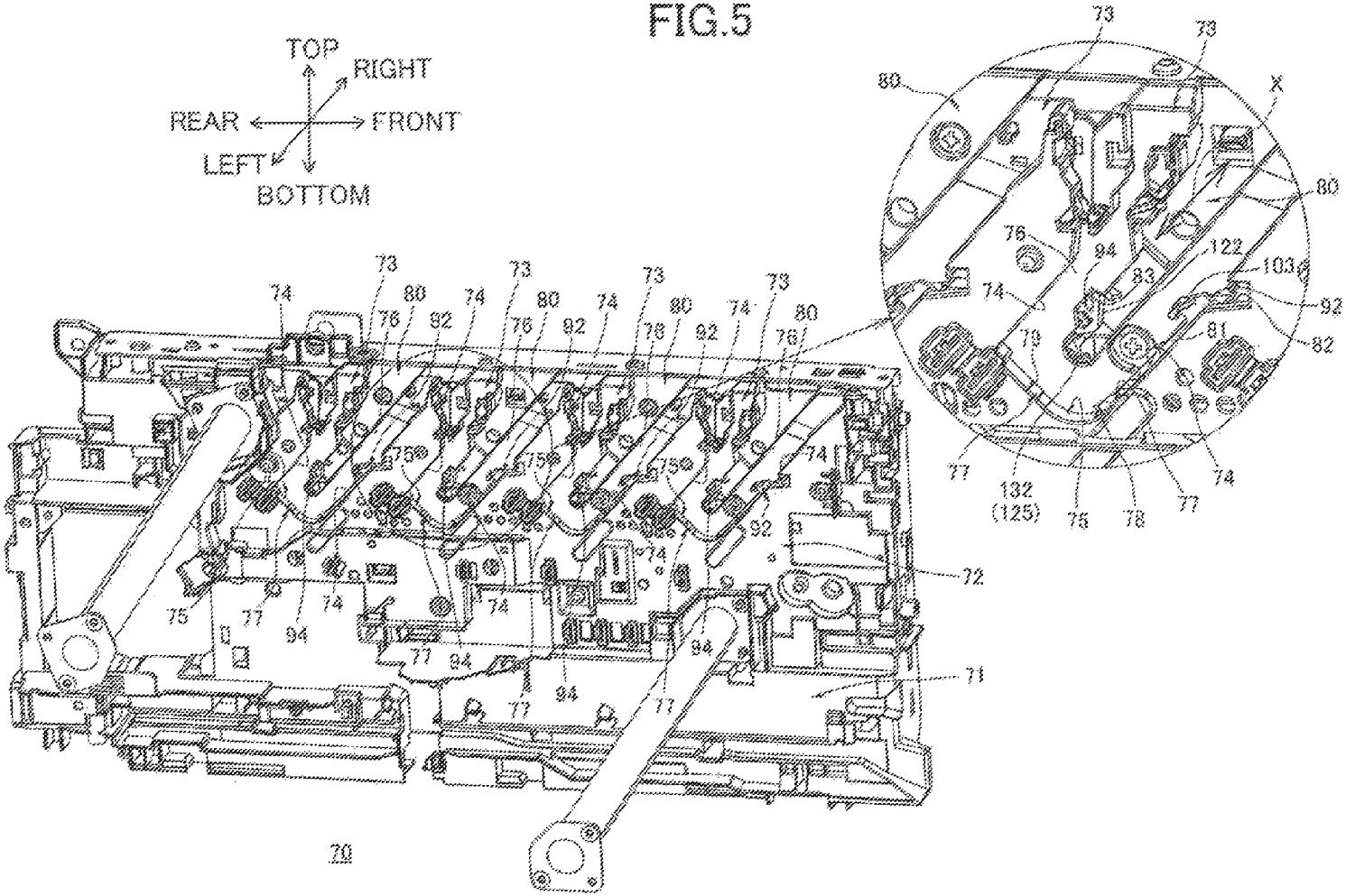
FIG. 5 is a perspective view of a right main side wall of the main casing as viewed from diagonally leftward and forward.

As shown in FIG. 5, the main side wall 70 includes a main frame 71, and a drum-support frame 72. The maim frame 71 is formed of polystyrene or another resin material. The main frame 71 has a generally flat plate shape and is substantially rectangular in a side view and elongated in the front-rear direction.

The drum-support frame 72 has a generally flat plate shape that is substantially rectangular in a side view and elongated in the front-rear direction. The drum-support frame 72 is formed of a glass fiber reinforces polycarbonate or other resin material. The vertical dimension of the drum-support frame 72 is approximately one-half that of the main frame 71. The drum-support frame 72 is disposed on the left side (inner side in the left-right direction) of the main frame 71 and is used to the left surface (inner surface in the left-right direction) of the main frame 71 at the upper portion thereof. The drum-support frame 72 is provided with bearing guide parts 73.

Four of the bearing guide parts 73 are provided to correspond to the four process cartridges 13. The bearing guide parts 73 are arranged parallel to each other and are spaced at intervals in the front-rear direction. Each of the bearing guide parts 73 is recessed from the top edge of the drum-support frame 72 diagonally downward and rearward. The bearing guide parts 73 are generally U-shaped in a side view. The bearing guide parts 73 are recessed rightward in the left surface of the drum-support frame 72 and expand rightward from the right surface of the drum-support frame 72 (see FIG. 6).

More specifically, each bearing guide part 73 is integrally configured of a pair of front and rear rail parts 74, a supporting part 75, and an enclosing part 76.

Each of the rail parts 74 is shaped to appear bent rightward from the left surface of the drum-support frame 73. The rail parts 74 extend in a direction sloping downward and rearward from the top edge of the drum-support frame 72 (i.e., in a mounting direction X described later). The rail parts 74 are arranged parallel to each other and are spaced apart in the front-rear direction by a distance greater than the outer diameter of the shaft-receiving part 47 on the bearing member 38 (see FIG. 3). The rail parts 74 serve as a track for mounting and removing the corresponding process cartridges 13. The front rail part 74 is formed with a lever insertion hole 81 (see FIG. 17).

The lever insertion hole 81 is generally rectangular in a front view and elongated vertically. The lever insertion hole 81 penetrates the lower portion of the front rail part 74 in the front-rear direction. The lever insertion hole 81 has a top portion formed with a retraction groove 82. The retraction groove 82 has a generally square shape in a side view and is recessed forward from the left edge of the front rail part 74.

The supporting part 75 is provided to connect the bottom edges of the rail parts 74 and is formed continuously with both bottom edges thereof. The supporting part 75 is generally U-shaped in a side view with its convex side facing downward (see FIG. 10).

The supporting part 75 is integrally provided with a pair of positioning protrusions 77. The positioning protrusions 77 are spaced apart in the front-rear direction and protrude into the interior of the bearing guide part 73 from the inner surface of the supporting part 75. The positioning protrusions 77 are generally rectangular in a side view.

Figure 10:
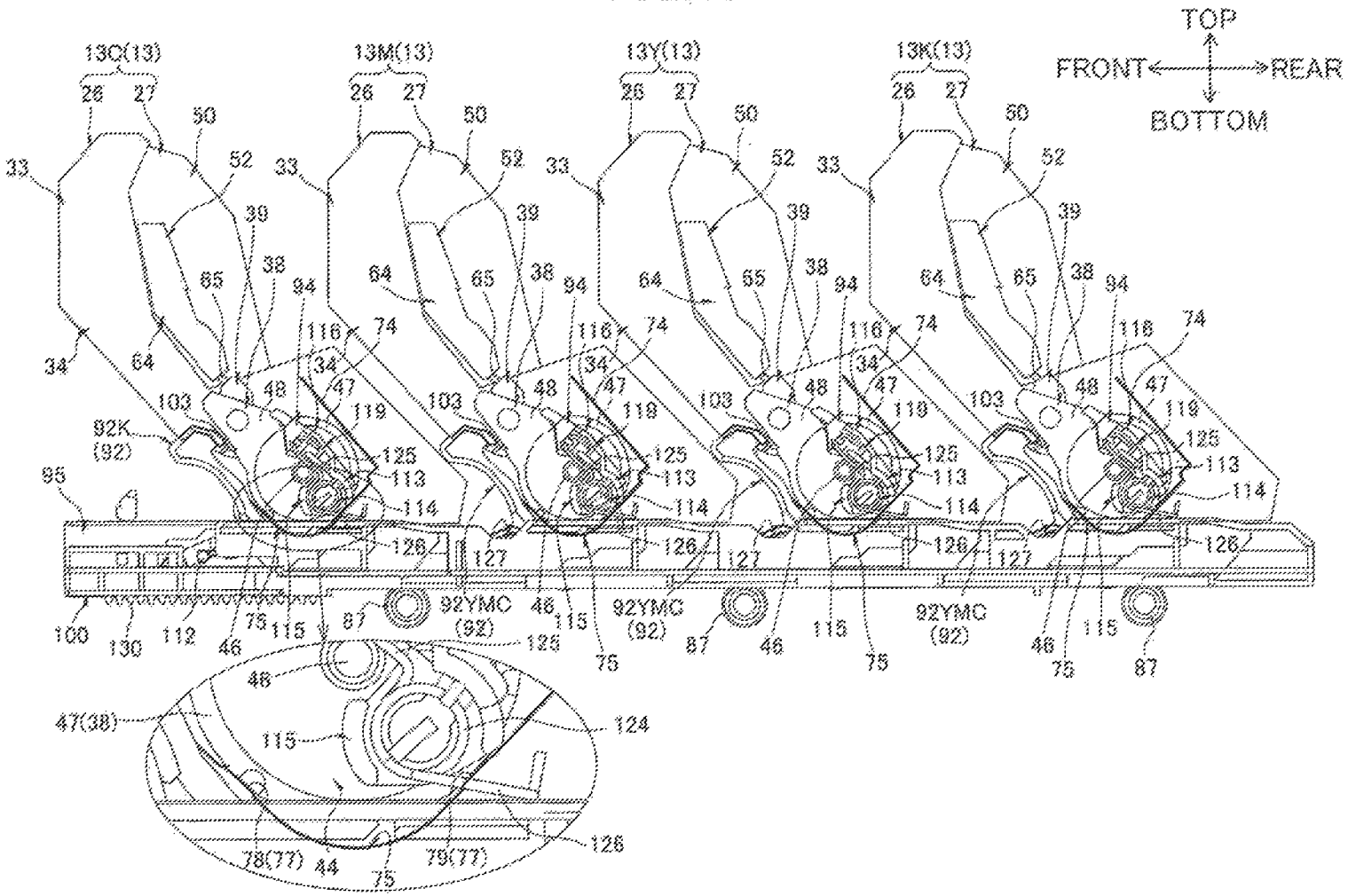
FIG. 10 is a right side view of the contact/separation locking mechanism.

More specifically, the front positioning protrusion 77 protrudes diagonally upward and rearward from the front portion of the supporting part 75, as shown in enlarged portion of FIG. 10. The distal endface of the front positioning protrusion 77 serves as an urging-force receiving surface 78 (see enlarged portion of FIG. 5). In a side view, the urging-force receiving surface 78 slopes diagonally downward and rearward, i.e., slopes to a direction front above forward to bottom rearward.

The rear positioning protrusion 77 protrudes diagonally upward and forward from the rear portion of the supporting part 75. The distal endface (upper front surface) of the rear positioning protrusion 77 functions as a reaction-force receiving surface 79. In a side view, the second receiving surface 79 slopes in a direction diagonally upward and rearward i.e., in a direction from above rearward to bottom forward. Hence, the urging-force receiving surface 78 and the reaction-force receiving surface 79 slope in different directions when viewed from the left or right side. In other words, the urging-force receiving surface 78 and the reaction-force receiving surface 79 are symmetrical to each other relative to an imaginary line extending vertically and passing the axis A shown in FIG. 2, i.e., rotational center of the photosensitive drum 17, as viewed from right-left direction.

As shown in FIG. 5, the enclosing part 76 is coupled with the right edges of the rail parts 74 and the supporting part 75. The enclosing part 76 is formed with a shaft fitting part 80.

The shaft fitting part 80 is formed in the approximate front-rear center region of the enclosing part 76 and extends obliquely downward and rearward from the top edge of the enclosing part 76. The shaft fitting part 80 is generally U-shaped in a side view and is recessed rightward from the left surface of the enclosing part 76 while expanding rightward from the right surface of the enclosing part 76 (see FIG. 6).

Figure 6:
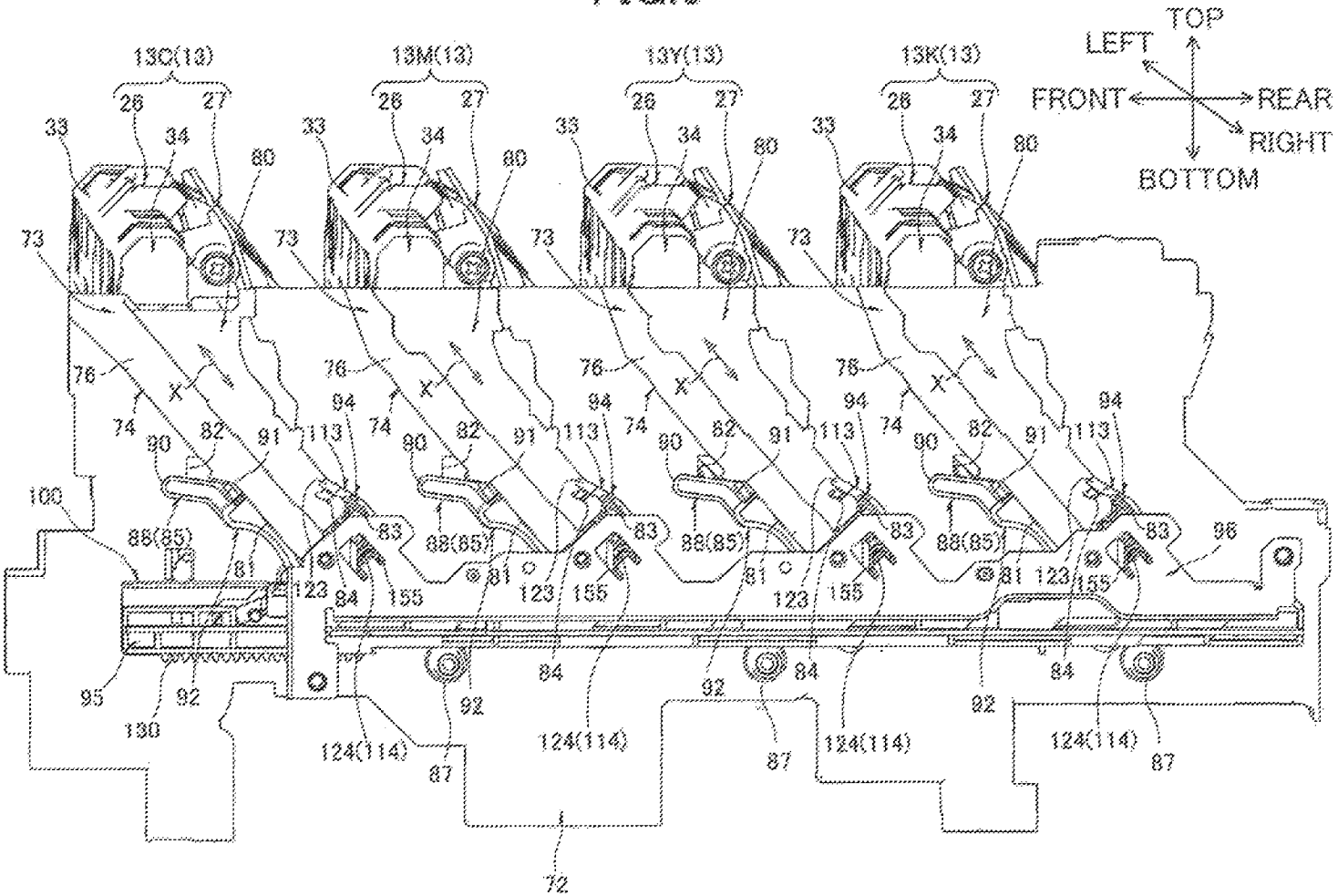
FIG. 6 is a right side view of a drum support frame of the main casing with the process cartridges mounted.

The shaft fitting part 80 has the rear wall formed with a locking-member exposing hole 83. The locking-member exposing hole 83 is generally rectangular in a rear view and elongated vertically. The locking-member exposing hole 83 perpetrates the rear wall of the shaft fitting part 80 in the front-rear direction near the bottom end thereof. As shown in FIG. 6, an engaging groove 84 is formed in the shaft fitting part 80 on the peripheral edge of the locking-member exposing hole 83. The engaging groove 84 has a generally square U-shape in a side view and is recessed obliquely downward and forward in the upper edge of the locking-member exposing hole 83 near the right end thereof.

Figure 7A:
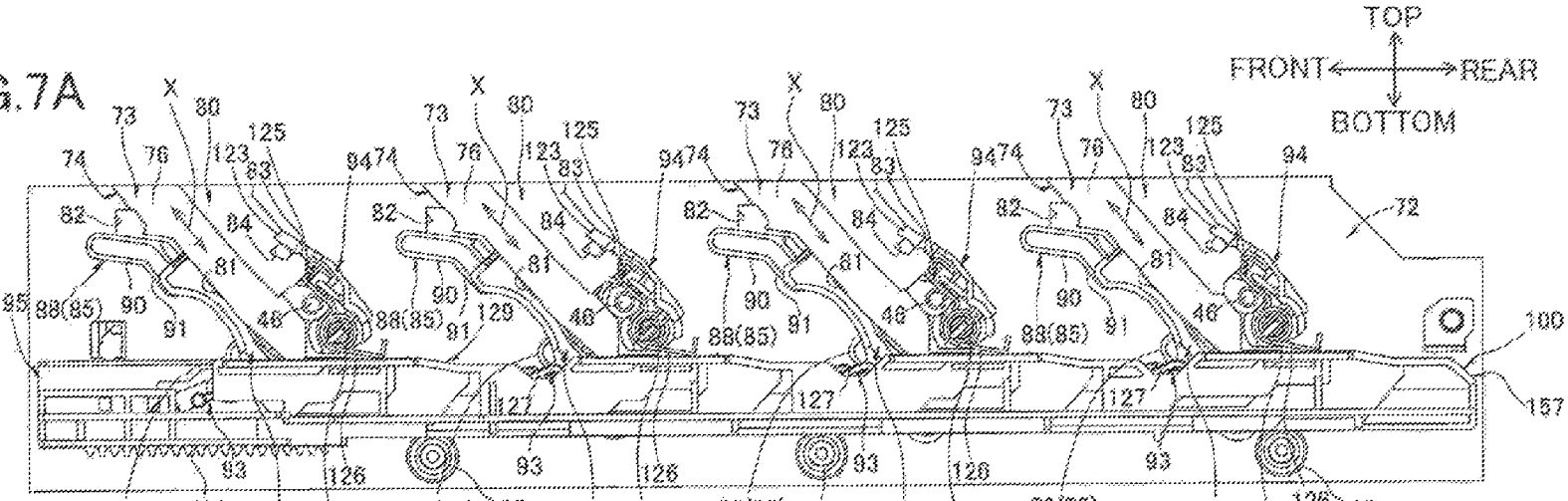
FIG. 7A is a right side view of a contact/separation locking mechanism shown in FIG. 6.
Figure 7B:
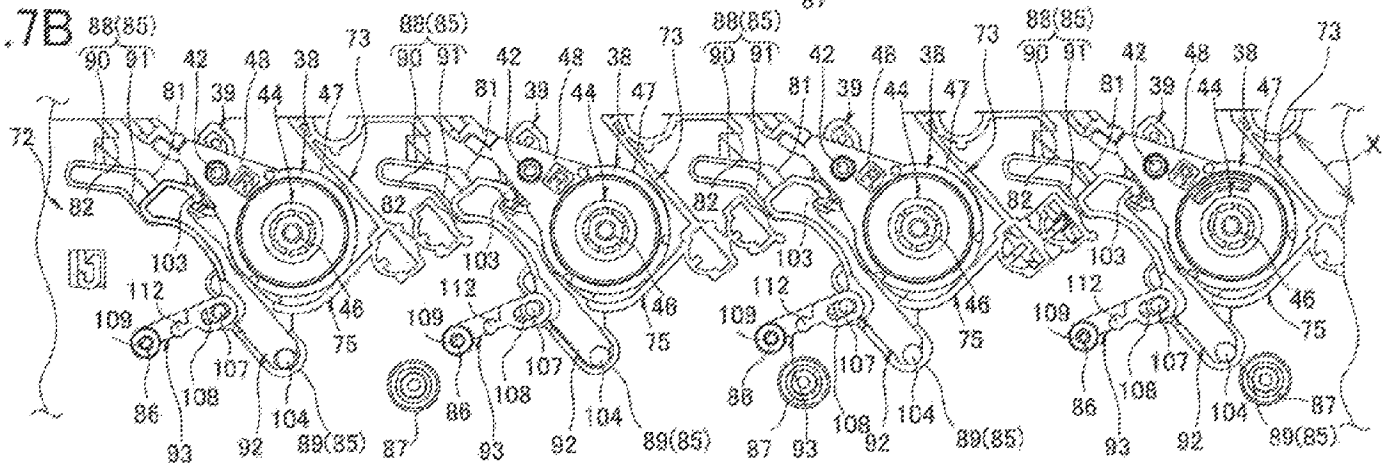
FIG. 7B is a right side view of a contact/separation lever and a linking member shown in FIG. 7A.

As shown in FIGS. 7A and 7B, lever guide parts 85, coupling rotational shafts 86, and cam supporting protrusions 87 are integrally provided on the right surface of the drum-support frame 72.

One lever guide part 85 is provided for each of the four bearing guide parts 73. Each lever guide part 85 includes a first guide part 88, and a second guide part 89.

The guide part 88 is disposed in front of the corresponding lever insertion hole 81 and below the corresponding refraction groove 82 and protrudes rightward from the right surface of the drum-support frame 72. The guide part 88 is integrally configured of a retraction guide part 90, and a contact/separation guide part 91.

The retraction guide part 90 is formed obliquely below and forward of the retraction groove 82 and slopes downward toward the rear, i.e., slopes in a direction from above forward to bottom rearward. The retraction guide part 90 has a general U-shape in a side view that is open on the lower rear end thereof. The inner vertical dimension of the retraction guide part 90 is approximately equal to the outer diameter of a first boss 101 described later.

The contact/separation guide part 91 also has a general U-shape in a side view that opens obliquely upward and forward on the upper front side thereof. The upper end (open end) of the contact/separation guide part 91 is formed continuously with the rear end (open end) of the retraction guide part 90. In other words, the contact/separation guide part 91 extends continuously in a direction diagonally downward and rearward from the rear end of the retraction guide part 90. The inner front rear dimension of the contact/separation guide part 91 is approximately equal to the outer dimension of the first boss 101 (described later).

As shown in FIG. 7B, the second guide part 89 is disposed obliquely downward and rearward of the corresponding guide part 88 and forward of the supporting part 75 on the corresponding shaft fitting part 80. The second guide part 89 has a general elliptical shape in a side view extending obliquely downward and rearward (along the mounting direction X described later) and protrudes rightward from the right surface of the drum-support frame 72. The inner front-rear dimension of the second guide part 89 is approximately equal to the outer dimension of a second boss 102 (described later).

One of the coupling rotational shafts 86 is provided on the front side of each second guide part 89 with a gap therebetween. The coupling rotational shafts 86 have a general columnar shape and protrude rightward from the right surface of the drum-support frame 72.

Three of the cam supporting protrusions 87 are provided on the right surface of the drum-support frame 72 at the lower edge thereof (see FIG. 6) and are spaced at intervals in the front-rear direction. The cam supporting protrusions 87 have a general columnar shape and protrude rightward from the right surface of the drum-support frame 72 so as to slidingly and movably support a translation cam 95 described later in the front-rear direction.

(2) Contact/Separation Locking Mechanism

FIG. 6 shows a contact/separation locking mechanism 100 and a metal plate 96 provided on the main side wall 70.

The contact/separation locking mechanism 100 is disposed on the right side of the drum-support frame 72 (the outer side in the left-right direction) so as to be interposed between the main frame 71 and the drum-support frame 72. The contact/separation locking-mechanism 100 includes contact/separation levers 92, linking members 93 (see FIG. 7), locking members 94, and the translation cam 95.

(2-1) Contact/Separation Levers

As shown in FIGS. 7A and 7B, four of the contact/separation levers 92 are provided to correspond to the four separating members 39. One of the contact/separation levers 92 is positioned on the front side of each bearing guide part 73.

In the following description, vertical, front-rear, and left-right directions related to the contact/separation lever 92 will be based on the state of the contact/separation lever 92 when the contact/separation lever 92 is in a pressing position described later (see FIGS. 6-11 and 16).

The contact/separation lever 92 has a generally flat plate shape that extends in a direction diagonally downward and rearward (along the mounting direction X described later). As shown in FIG. 8, each contact/separation lever 92 is integrally provided with the first boss 101, the second boss 102, a third boss 104, a pressing part 103, an expanded part 111, and a coupling boss 107 (see FIG. 7B).

The first boss 101 is provided to correspond to the guide part 88 of the lever guide part 85 (see FIG. 7B). The first boss 101 has a general columnar shape and protrudes leftward from the left surface of the contact/separation lever 92 at the top end thereof.

The second boss 102 is provided to correspond to the second guide part 89 of the lever guide part 85 (see FIG. 7B). The second boss 102 has a general columnar shape and protrudes leftward from the left surface of the contact/separation lever 92 at the bottom end thereof.

The third boss 104 is provided to correspond to a lever guide groove 134 (described later) of the translation cam 95. The third boss 104 has a general columnar shape and protrudes rightward from the right surface of the contact/separation lever 92 at the bottom end thereof.

The pressing part 103 is provided to correspond to the lower fin 205 of the separating member 39. The pressing part 103 has a general rectangular shape in a side view and protrudes obliquely downward and rearward from the rear edge of the contact/separation lever 92 at the top end thereof.

The expanded part 111 protrudes obliquely downward and forward from the front edge of the contact/separation lever 92 at the approximate vertical center thereof. The expanded pan 111 has a general semicircular shape in a side view.

As shown in FIG. 7B, the coupling boss 107 has a general columnar shape and protrudes rightward from the right surface of the expanded part 111.

The contact/separation lever 92 is disposed on the front side of the corresponding bearing guide part 73 such that the first boss 101 is slidably fitted into the corresponding guide part 88 and the second boss 102 is slidably fitted into the corresponding second guide part 89. As will be described later, the contact/separation lever 92 can move among a pressing position, a pressure release position, and a retracted position while the first boss 101 is guided in the contact/separation guide part 91 of the guide part 88 and the second boss 102 is guided in the second guide part 89.

(2-2) Linking Members

Figure 9:
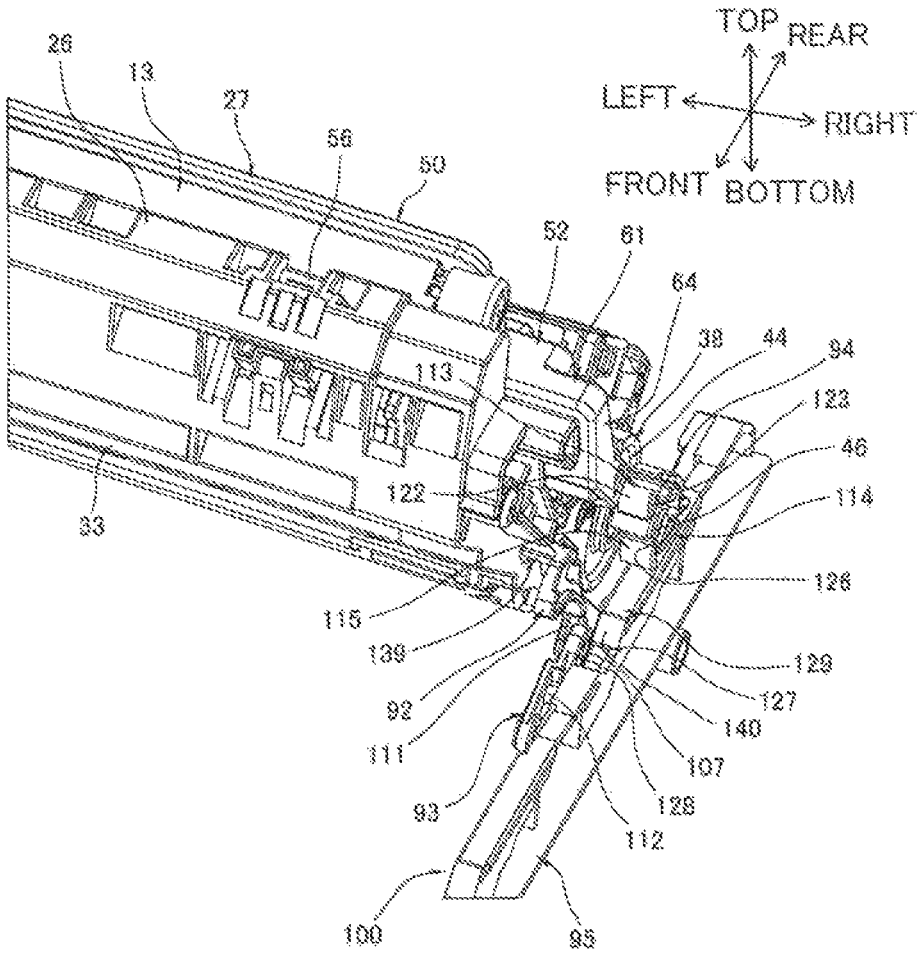
FIG. 9 is a partial perspective view of the contact/separation locking mechanism as viewed from diagonally rightward and forward.

Four of the linking members 93 are provided to correspond to the four contact/separation levers 92. One linking member 93 is disposed on the front side of each contact/separation lever 92. The linking members 93 have a generally flat plate shape extending obliquely upward and rearward. As shown in FIG. 9, the linking member 93 is shaped like a crank in a plan view such that the rear portion is positioned relatively rightward than the front portion and the front portion relatively leftward than the rear portion. Each linking member 93 is formed with a coupling-boss insertion hole 108 (see FIG. 7B), and a rotational-shaft insertion hole 109 (see FIG. 8).

The coupling-boss insertion hole 108 has a general elliptical shape in a side view and is elongated in a direction sloping upward and rearward. The coupling-boss insertion hole 108 penetrates the rear end of the linking member 93. The minor axis of the coupling-boss insertion hole 108 is approximately equal to the outer diameter of the coupling boss 107, while the major axis is approximately two times the outer diameter of the coupling boss 107.

The rotational-shaft insertion hole 109 is generally circular in a side view and penetrates the front end of the corresponding linking member 93. The inner diameter of the rotational-shaft insertion hole 109 is approximately equal to the outer diameter of the coupling rotational shaft 86.

As shown in FIG. 7B, the linking member 93 is also provided with an engaging boss 112. The engaging boss 112 has a general columnar shape and protrudes rightward from the right surface of the linking member 93 in the approximate front-rear corner thereof (see FIG. 9). Hence, when viewed in the left-right direction, the engaging boss 112 is positioned between the coupling-boss insertion hole 108 and the rotational-shaft insertion hole 109.

The linking members 93 are supported on the drum-support frame 72 so as to be capable of rotating relative to the drum-support frame 72 about the coupling rotational shaft 86 by rotatably inserting the coupling boss 107 in the coupling-boss insertion hole 108 and rotatably inserting the coupling rotational shaft 86 into the rotational-shaft insertion hole 109.

(2-3) Locking Members

As shown in FIG. 7A, four of the locking members 94 are provided to correspond to the shafts 46 of the four photosensitive drums 17. One of the locking members 94 is disposed on the rear side of the corresponding shaft fitting part 80. As shown in FIG. 8, each locking member 94 is provided with a spring retaining member 113, and a spring member 114.

Figure 11:
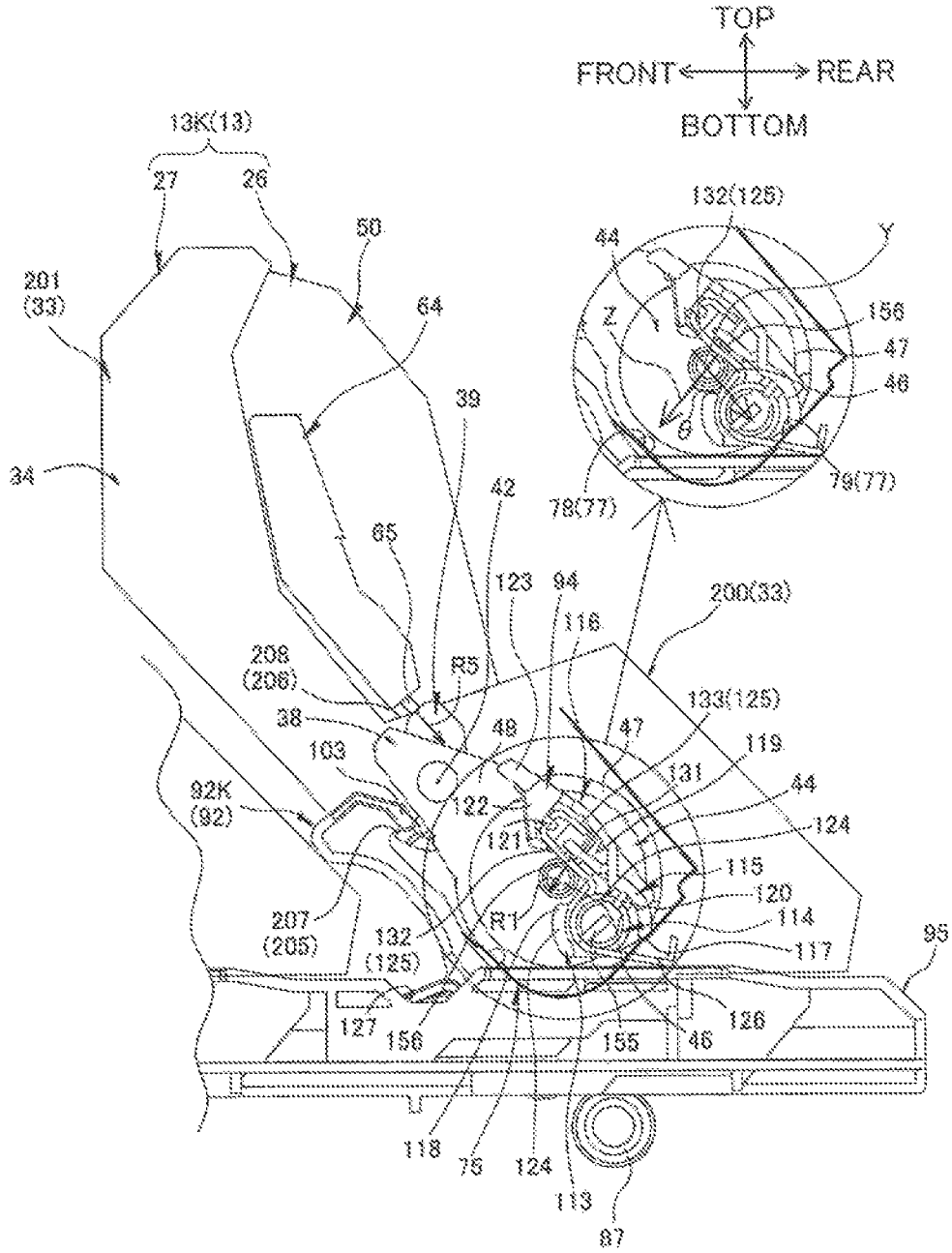
FIG. 11 is an enlarged partial right side view of the process cartridge and the contact/separation locking mechanism.

The spring retaining member 113 is formed of an insulating member, such as polyacetal resin, and is integrally configured of a coil cover part 115, and a shaft opposing part 116. The coil cover part 115 has a general cylindrical shape that is elongated in the left-right direction. As shown in FIG. 11, a first anchoring protrusion 120 is integrally provided on the inner circumferential surface of the coil cover part 115 on the upper rear side thereof.

The first anchoring protrusion 120 is formed on the inner circumferential surface of the coil cover part 115 and protrudes inward from the right edge of the inner circumferential surface in a radial direction of the coil cover part 115. The distal edge of the first anchoring protrusion 120 is bent leftward to form a hook shape in cross-section.

The coil cover part 115 is formed with a first cutout part 117 and a second cutout part 118. The first cutout part 117 is formed by cutting out a portion from the bottom of the coil cover part 115 while the second cutout part 118 is formed by cutting out a portion from the top of the coil cover part 135.

The shaft opposing part 116 has a general parallelepiped shape that extends in a direction obliquely upward and forward from a circumferential end of the coil cover part 115 on the rear side of the second cutout part 118.

As shown in FIG. 11, an anchoring groove 119 is formed in the shaft opposing part 116. The anchoring groove 119 has a generally square U-shape in a side view and is recessed in the front surface of the shaft opposing part 116 in a direction obliquely upward and rearward. A second anchoring protrusion 121 and a spring pressing part 131 are provided on the inner surface of the anchoring groove 119.

The second anchoring protrusion 121 protrudes obliquely downward and rearward from the upper front surface of the anchoring groove 119. The distal end of the second anchoring protrusion 121 bends leftward to form a hook shape in cross section.

The spring pressing part 131 has a generally flat plate shape and extends diagonally upward and forward from the lower rear surface of the anchoring groove 119. The spring pressing part 131 is elongated in the left-right direction. A protruding part 156 is integrally provided on the spring pressing part 131.

The protruding part 156 has a general rectangular shape in a side view and protrudes obliquely downward and forward from the front surface of the spring pressing part 131 at the top end thereof. The protruding part 156 is elongated in the left-right direction to form a ridge-like shape.

An extension part 122 and an engaging part 123 are integrally provided on the shaft opposing part 116. As shown in FIG. 8, the extension part 122 extends continuously upward from the front end of the shaft opposing part 116. The extension part 122 has a generally flat plate shape.

The engaging part 123 extends continuously in a direction obliquely upward and forward front the right edge of the extension part 122 at the top end thereof. The engaging part 123 has a generally flat plate shape.

The spring member 114 is a torsion coil spring formed of an electrically conductive material, such as metal. A middle portion of the spring member 114 is wound multiple times to form a coil part 124. Specifically, the spring member 114 is integrally configured of the coil part 124, a shaft contacting part 125, and a cam contacting part 126.

The coil part 124 has an air-core coil shape extending in the left-right direction. The outer diameter of the coil part 124 is smaller than the inner diameter of the coil cover part 115. The coil part 124 is accommodated in the coil cover part 115 of the spring retaining member 113 and anchored by the first anchoring protrusion 120. Hence, the coil cover part 115 covers the radial outside of the coil part 124.

The shaft contacting part 125 is formed continuously from the left end of the coil part 124 in a linear shape that extends obliquely upward and forward. The shaft contacting part 125 is led from the coil cover part 115 via the second cutout part 118. More specifically, the shaft contacting part 125 has a first portion 132 that extends in a direction diagonally upward and forward, and a second portion 133 that extends continuously upward and rearward from the top end of the first portion 132, then bends and extends in a direction diagonally downward and rearward.

The first portion 132 of the shaft contacting part 125 is provided on the front side of the spring pressing part 131 so that the protruding part 156 is in contact with the first portion 132 from upper rear side. The second portion 133 of the shaft contacting part 125 is accommodated in the anchoring groove 119 and anchored to the spring retaining member 113 by the second anchoring protrusion 121.

The cam contacting part 126 is formed continuously with the right end of the coil pan 124 in a linear shape extending first in a direction obliquely downward and rearward, then bends and extends leftward (see FIG. 8). The cam contacting part 126 is led from the coil cover pan 115 through the first cutout part 117.

As shown in FIG. 7A, the locking members 94 are pivotably supported on the right surface of the drum-support frame 72 at positions obliquely downward and rearward from the corresponding shaft fitting parts 80. The extension part 122 and the first portion 132 of each shaft contacting part 125 extend into the corresponding shaft fitting part 80 through the locking-member exposing hole 83, as shown in FIG. 5, and the engaging part 123 is positioned inside the engaging groove 84, as shown in FIG. 7A.

As shown in FIG. 9, the locking member 94 is disposed on the front side of the contact/separation lever 92 while being separated therefrom. The locking member 94 and the contact/separation lever 92 are juxtaposed in the front-rear direction so as not to overlap each other in a left-right projection.

(2-5) Translation Cam

As shown in FIG. 7A, the translation cam 95 is disposed to the right of the contact/separation levers 92 and the linking members 93. The translation cam 95 has a general parallelepiped shape extending in the front-rear direction.

Figure 12:
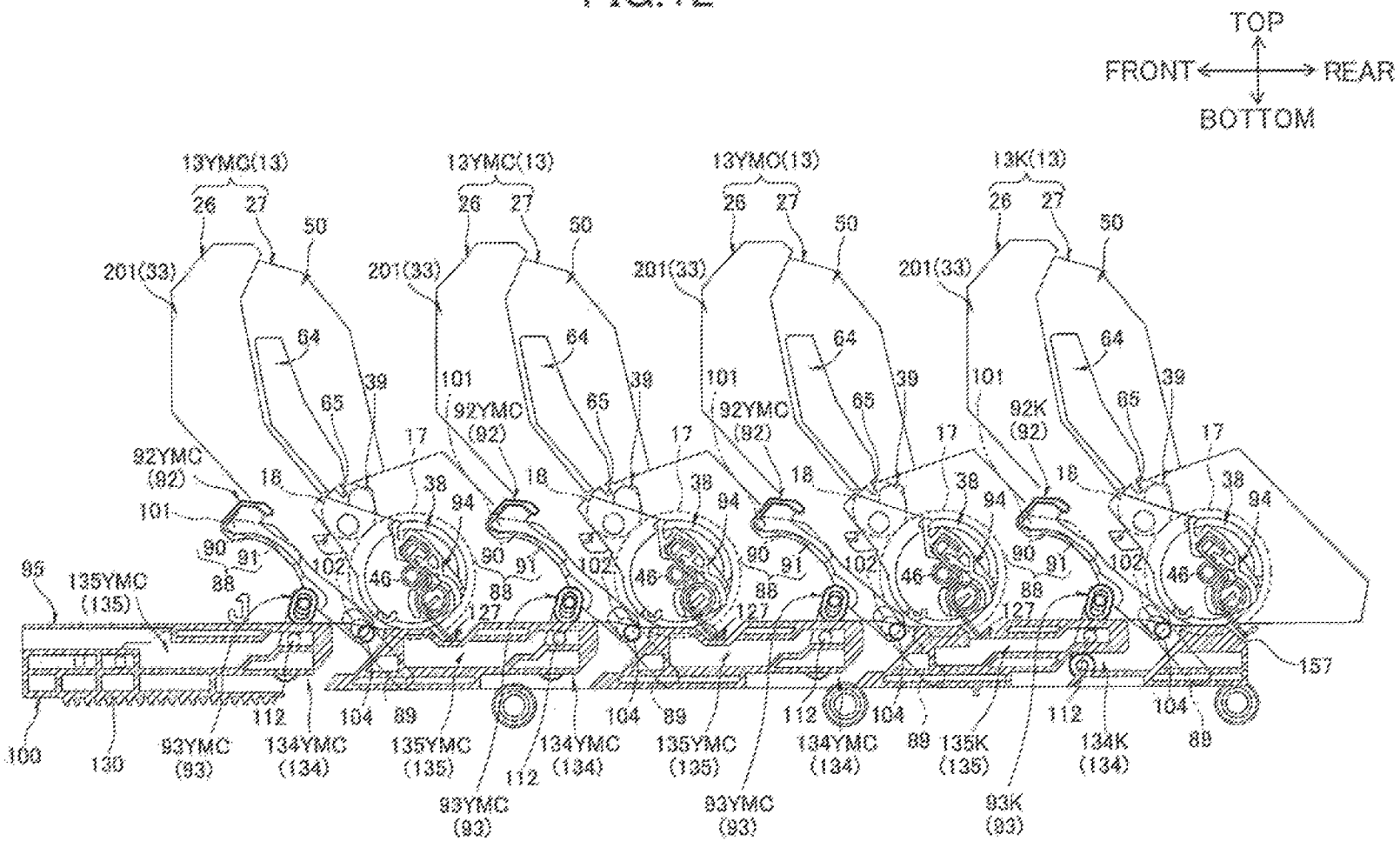
FIG. 12 is a right side view of the process cartridge and the contact/separation locking mechanism when a translation cam is positioned at a mounting/removal allowing position.

As shown in FIG. 12, a cutout part 157 and lock releasing grooves 127 are formed in the top surface of the translation cam 95.

Figure 13:
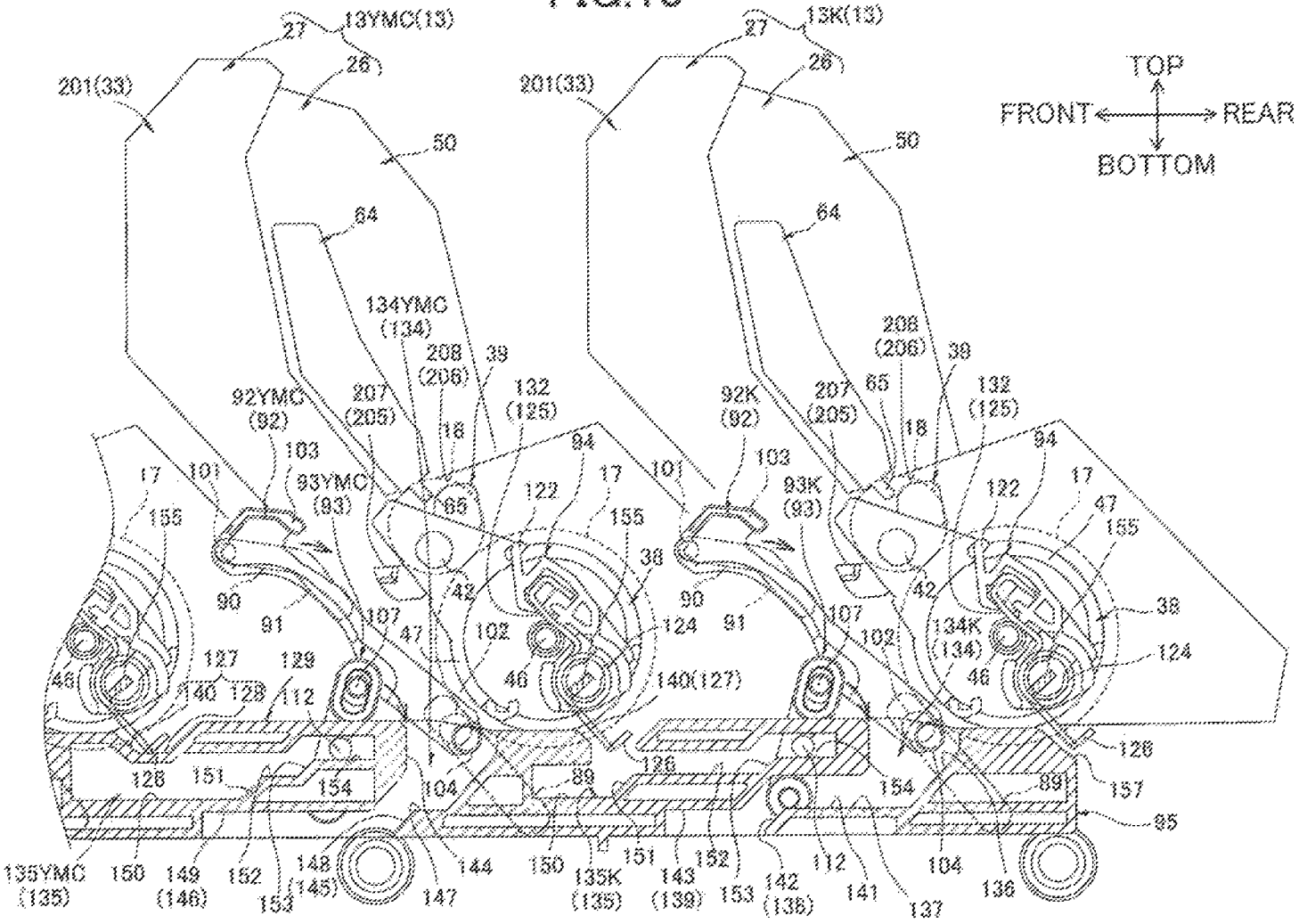
FIG. 13 is a right side view of the black process cartridge, the yellow process cartridge, and the contact/separation locking mechanism when the translation cam is positioned at the mounting/removal allowing position.

As shown in FIG. 13, the cutout part 157 is formed in a position corresponding to the cam contacting part 126 of the locking member 94 for the black process cartridge 13K. The cutout part 157 is formed by cutting the upper rear edge of the translation cam 95 to form a beveled edge sloping downward toward the rear.

As shown in FIG. 12, three of the lock releasing grooves 127 are formed in the top surface of the translation cam 95 at intervals in the front-rear direction. The lock releasing grooves 127 are positioned to correspond to the locking members 94 for the respective yellow process cartridge 13Y, magenta process cartridge 13M, and cyan process cartridge 13C, i.e., the three process cartridges 13 other than the black process cartridge 13K (hereinafter referred to as the three process cartridges 13YMC). As shown in FIG. 13, the lock releasing grooves 127 are recessed from the top surfaces of the translation cam 95 and have a general trapezoidal shape in a side view. The deepest part (bottom surface) of each lock releasing groove 127 is defined as a level surface 128 that extends in the front-near direction. The surfaces of the lock releasing groove 127 connecting each of the front and rear edges of the level surface 128 to the top surface of the translation cam 95 are defined as connecting surfaces 140. Further, the areas on the top surface of the translation cam 95 in which the lock releasing grooves 127 are not formed are defined collectively as a contact surface 129, as illustrated in FIG. 13. Thus the level surface 128 is positioned lower than the contact surface 129 (nearer the opposite side of the translation cam 95 from the contact surface 129). That is, the level surface 128 is opposed to the locking member 94 with respect to the contact surface 129.

The translation cam 95 has the bottom front portion provided with a rack gear 130 extending in the front-rear direction as shown in FIG. 10. As shown in FIG. 8, the translation cam 95 has the left surface formed with lever guide grooves 134 and linking-member guide grooves 135.

Four of the lever guide grooves 134 are arranged in positions spaced at intervals in the front-rear direction and corresponding to the third boss 104 of the four contact/separation levers 92. Specifically, the lever guide grooves 134 include a black lever guide groove 134K corresponding to the black process cartridge 13K, and three lever guide grooves 134YMC corresponding to the three process cartridges 13YMC.

The black lever guide groove 134K is formed in the left surface of the translation cam 95 near the rear end thereof. The black lever guide groove 134K has a retracting groove part 136, a supporting groove part 137, a guiding groove pad 138, and a retracting groove part 139 (see FIG. 13).

As shown in FIG. 13, the retracting groove part 130 is formed in the upper portion on the left surface of the translation cam 95 and has a general rectangular shape in a side view that is elongated vertically. The retracting groove part 136 is recessed rightward from the left surface of the translation cam 95. The vertical and front-rear dimensions of the retracting groove part 136 are greater than the outer diameter of the third boss 104.

The supporting groove part 137 is formed continuously with the deepest portion (bottom portion) of the retracting groove part 130 and is recessed forward therefrom. The vertical dimension of the supporting groove part 137 is approximately equal to the outer diameter of the third boss 104. The bottom edge of the retracting groove part 136 and the supporting groove part 137 are defined as a support surface 141 and oriented in the front-rear direction.

The guiding groove part 138 is formed continuously with the front portion of the supporting groove part 137 and is recessed in a direction diagonally downward and forward therefrom. The rear edge (lower rear edge) of the guiding groove pan 138 is defined as a guide surface 142 that is formed continuously with the front edge of the support surface 141 and slopes downward toward the front.

The restricting groove pan 139 is formed continuously with the bottom portion of the guiding groove part 138 and is recessed forward therefrom. The upper edge of the restricting groove part 139 is defined as a restriction surface 143 and extends in the front-rear direction.

As shown in FIG. 8, each of the three lever guide grooves 134YMC has a retracting groove part 144, a guiding groove part 145, and a restricting groove part 146.

As shown in FIG. 13, the retracting groove part 144 is formed in the upper portion of the left surface of the translation cam 95. The retracting groove part 144 is generally rectangular in a side view and elongated vertically and is recessed rightward from the left surface of the translation cam 95. The vertical and front-rear dimensions of the retracting groove part 144 are greater than the outer diameter of the third boss 104. The bottom edge of the retracting groove part 144 is defined as a support surface 147 that is elongated in the front-rear direction. The front-rear length of the support surface 147 is shorter than the front-rear length of the support surface 141.

The guiding groove part 145 is formed continuously from the bottom portion of the retracting groove part 144 and is recessed in a direction diagonally downward and forward therefrom. The rear edge (lower rear edge) of the guiding groove part 145 is defined as a guide surface 148 that is formed continuously with the front edge of the support surface 147 and slopes downward toward the front.

The restricting groove part 146 is formed continuously with the bottom portion of the guiding groove part 145 and is recessed forward therefrom. The top edge of the restricting groove part 146 is defined as a restriction surface 149 that is aligned in the front-rear direction.

As shown in FIG. 12, four of the linking-member guide grooves 135 are formed in the left surface of the translation cam 95 to correspond with the engaging bosses 112 of the four linking members 93. Specifically, the linking-member guide grooves 135 include a black linking-member guide groove 135K corresponding to the black process cartridge 13K, and three linking-member guide grooves 135YMC corresponding to the three process cartridges 13YMC.

The black linking-member guide groove 135K is formed in the left surface of the translation cam 95 at a position obliquely above and forward of the black lever guide groove 134K. The three linking-member guide grooves 135YMC are formed to the left surface of the translation cam 95 at positions obliquely above and forward of the respective three lever guide grooves 134YMC.

As shown in FIG. 8, the linking-member guide grooves 135 are generally rectangular in a side view and elongated in the front-rear direction. The linking-member guide grooves 135 are recessed rightward from the left surface of the translation cam 95. As shown in FIG. 13, the bottom edge of each linking-member guide groove 135 has an opposing surface 150, a first sloped surface 151, a first level support surface 152, a second sloped surface 153, and a second level support surface 154.

The opposing surface 150 extends in the front-rear direction and constitutes the front end of the lower edge of the linking-member guide groove 135. The front-rear length of the opposing surface 150 constituting the black linking-member guide groove 135K is shorter than the front-rear length of the opposing surfaces 150 constituting the three linking-member guide grooves 135YMC.

The first sloped surface 151 is formed continuously with the rear edge of the opposing surface 150 and slopes upward toward the rear. The first level support surface 152 is formed continuously with the rear edge of the first sloped surface 151 and extends rearward therefrom. The front-rear length of the first level support surface 152 constituting the black linking-member guide groove 135K is longer than the front-rear length of the first level support surfaces 152 constituting the three linking-member guide grooves 135YMC.

The second sloped surface 153 is formed continuously with the rear edge of the first level support surface 152 and slopes upward toward the rear. The second level support surface 154 is formed continuously with the rear edge of the second sloped surface 153 and extends rearward therefrom.

The translation cam 95 is disposed on the right side of the contact/separation levers 92 and the linking members 93 (see FIG. 7A) with the third bosses 104 slidably inserted into the corresponding lever guide grooves 134 and the engaging bosses 112 slidably inserted into the corresponding linking-member guide grooves 135, as shown in FIG. 12. In this way, the translation cam 95 is coupled to the contact/separation levers 92 through the linking members 93.

As shown in FIG. 7A, the translation cam 95 is disposed at a vertical position between the four locking members 94 and the three cam supporting protrusions 87. As will be described later, the translation cam 95 can slide in the front-rear direction.

(3) Metal Plate

As shown in FIG. 6, the metal plate 94 is formed of a metal. The metal plate 96 has a generally flat plate shape that is substantially rectangular in a side view and elongated in the front-rear direction.

A plurality of protrusions 155 is integrally provided on the left surface of the metal plate 96, as shown in FIG. 13. Specifically, four of the protrusions 155 are provided on the left surface of the metal plate 96 at intervals in the front-rear direction to correspond with the coil parts 124 of four spring members 114. The protrusions 155 have a generally flat plate shape and protrude leftward from the left surface of the metal plate 96. The protrusions 155 have a cross-sectional shape that slopes upward toward the forward, as shown in FIG. 11.

As shown in FIG. 6, the metal plate 96 is placed on the right side of the translation cam 95 and the locking members 94 (see FIG. 11) and is fixed to the right surface of the drum-support frame 72 by inserting the protrusions 155 into the corresponding coil parts 124.

4. Operations for Mount and Removal of Process Cartridges Relative to Main Casing Next, operations for mounting a process cartridge 13 in and removing a process cartridge 13 from the main casing 2 will be described.

(1) Operations for Mounting Process Cartridge in Main Casing

In order to mount a process cartridge 13 in the main casing 2, first the operator places the top cover 6 in the open position to expose the access opening 5. As the top cover 6 is opened, the translation cam 95 moves forward in association with the movement of the top cover 6 according to an interlocking mechanism well known in the art. When the top cover 6 is fully opened, the translation cam 95 is in its forwardmost position. This is the mounting/removal allowing position shown in FIG. 12.

In the following description, the contact/separation lever 92 and the linking member 93 corresponding to the black process cartridge 13K will be referred to as the black contact/separation lever 92K and the black linking member 93K, respectively. Similarly, the contact/separation levers 92 and the linking members 93 corresponding in the three process cartridges 13YMC will be referred to as the three contact/separation levers 92YMC and the three linking members 93YMC, respectively.

Further, contact and separation operations related to the developer cartridges 27 of the three process cartridges 13YMC are identical for each of the three process cartridges 13YMC. Accordingly, the yellow process cartridge 13Y is used to represent all of the three process cartridges 13YMC in FIGS. 13-16 for simplification, and descriptions of these operations for the magenta process cartridge 13M and the cyan process cartridge 13C have been omitted.

When the translation cam 95 is to the mounting/removal allowing position, the retracting groove part 136 of the black lever guide groove 134K opposes the third boss 104 of the black contact/separation lever 92K in the left-right direction, as shown in FIG. 13. Similarly, the retracting groove parts 144 of the three lever guide grooves 134YMC oppose the third bosses 104 of the corresponding three contact/separation levers 92YMC in the left-right direction. Further, the second level support surfaces 154 of all linking-member guide grooves 135 are positioned beneath the corresponding engaging bosses 112 and support these engaging bosses 112 from below. Consequently, all linking members 93 are aligned vertically in an erect orientation, with the coupling bosses 107 of the corresponding contact/separation levers 92 disposed in the upper positions within the coupling-boss insertion holes 108.

Figure 17:
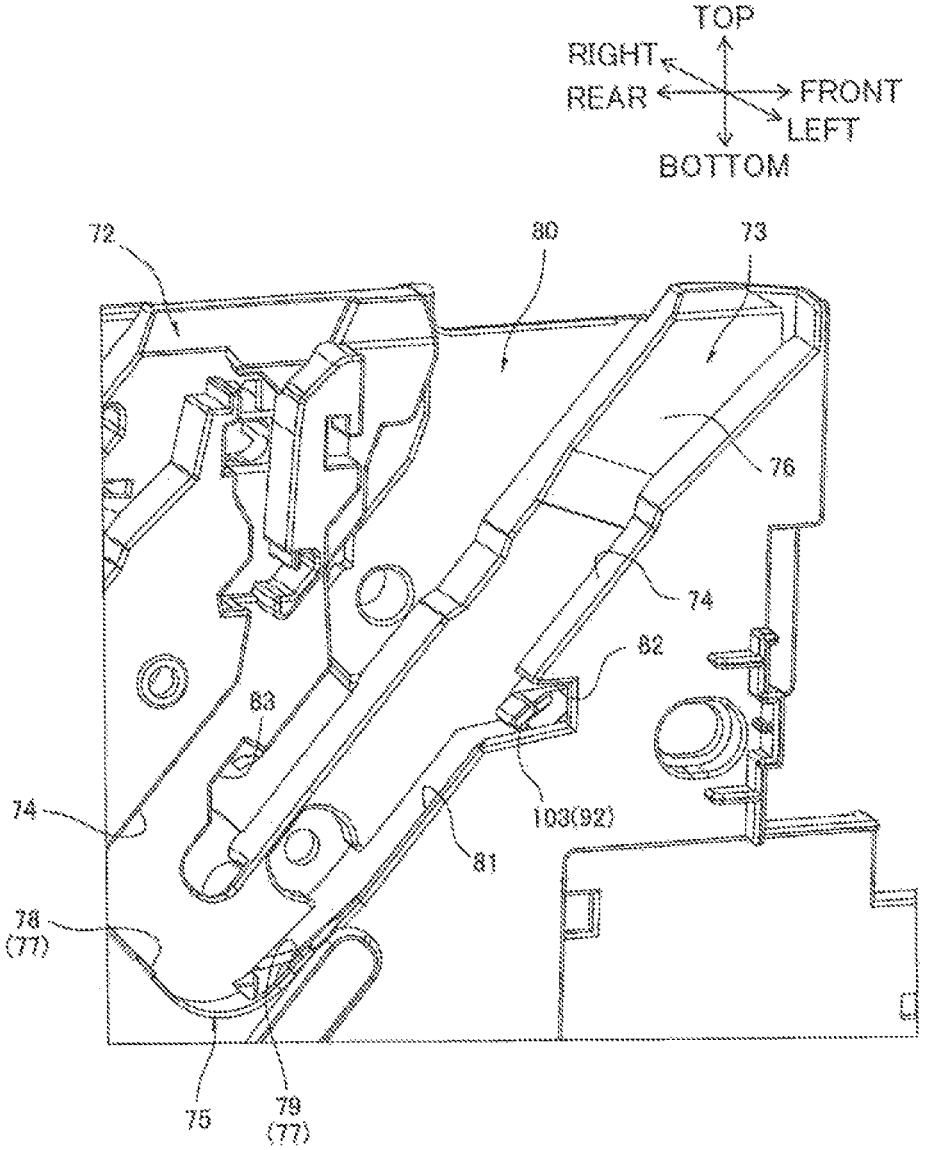
FIG. 17 is a perspective view of a bearing guide part shown in FIG. 5 as viewed from diagonally leftward and rearward when the translation cam is positioned at the mounting/removal allowing position.

At this time, the contact/separation levers 92 are disposed in their retracted positions in which the first bosses 101 are present in the front ends of the corresponding retraction guide parts 90, and the second bosses 102 are present in the top ends of the corresponding second guide parts 89 as indicated by two-dotted line in FIG. 13. When the contact/separation levers 92 and in their refracted positions, the pressing part 103 of each contact/separation lever 92 is retracted from the corresponding bearing guide part 73 to a position forward of the corresponding lever insertion hole 81, as shown in FIG. 17. Hence, in its retracted position, the contact/separation lever 92 is refracted from the mounting/removal locus of the process cartridge 13 (hereinafter referred to simply as the path of the process cartridge 13).

Further, the cutout part 157 and the lock releasing grooves 127 formed in the translation cam 95 are positioned beneath the corresponding locking members 94, as shown in FIG. 13. Thus, the cam contacting part 126 on the rearmost locking member 94 confronts the cutout pan 157 with a slight gap therebetween and the cam contacting parts 120 of the other locking members 94 are positioned in the lock releasing grooves 127 and confront the level surfaces 128. At this time, the engaging parts 123 of the locking members 94 are positioned inside the corresponding engaging grooves 84 and contact (engage with) the peripheral edges of the engaging grooves 84, as shown in FIG. 6.

Next, the operator places the process cartridge 13 above the desired position in the main casing 2 and inserts the process cartridge 13 diagonally downward and rearward, as shown in FIG. 5, so that the shaft-receiving parts 47 of the left and right bearing members 38 are fitted into the corresponding bearing guide parts 73 (see FIG. 3). Through this operation, the shaft 46 provided in the right flange member 44 is fitted into the corresponding shaft fitting part 80.

When inserting the process cartridge 13 into the main casing 2, the process cartridge 13 moves diagonally downward and rearward as the shaft-receiving parts 47 are guided by the rail parts 74. This direction is referred to as the mounting direction X shown in FIG. 6.

When the shaft-receiving parts 47 arrive at the supporting parts 75, as shown in FIG. 10, the supporting parts 75 restrict further downward movement of the process cartridge 13. At this time, the process cartridge 13 is in its prescribed mounted position inside the main casing 2. In this state, the urging-force receiving surfaces 78 of the front positioning protrusions 77 is brought into contact with the bearing members 38 from the lower front side thereof, and the reaction-force receiving surfaces 79 of the rear positioning protrusions 77 is brought into contact with the bearing members 38 from the lower rear side thereof. Hence, the left and right flange members 44 are supported on the pairs of positioning protrusions 77 through the shaft-receiving parts 47, thereby positioning the photosensitive drum 17 relative to the main side walls 70. In addition, the shaft 46 is fitted into the deepest part (bottom end) of the shaft fitting part 80, and the first portion 132 of the shaft contacting part 125 constituting the locking member 94 contacts the shaft 46 from the upper rear side thereof. In this state, as shown in FIG. 13, the first portion 132 of the slab contacting part 125 presses the shaft 46 diagonally downward and forward with a force smaller than an urging force R1 described later, thereby urging the flange member 44 toward the urging-force receiving surface 78 through the shaft 46.

This completes the operations for mounting the process cartridge 13 in the main casing 2. Operations for removing a process cartridge 13 from the main casing 2 are achieved by performing the operations for mounting the process cartridge 13 in reverse order.

Specifically, the operator pulls the process cartridge 13 diagonally upward and forward from the main casing 2 along the mounting direction X as the shaft-receiving parts 47 are guided by the bearing guide parts 73. Through this operation, the process cartridge 13 is removed from the main casing 2.

5. Contact/Separation Operations of Developing Rollers Relative to Photosensitive Drums Next, the operations for placing the developing rollers 18 in contact with and for separating the developing rollers 18 from the corresponding photosensitive drums 17 will be described.

The operating mode on the printer 1 can be switched among a color mode for forming color images, a monochrome mode for forming images in black only, and a non image-forming mode in which images are not formed.

Figure 14:
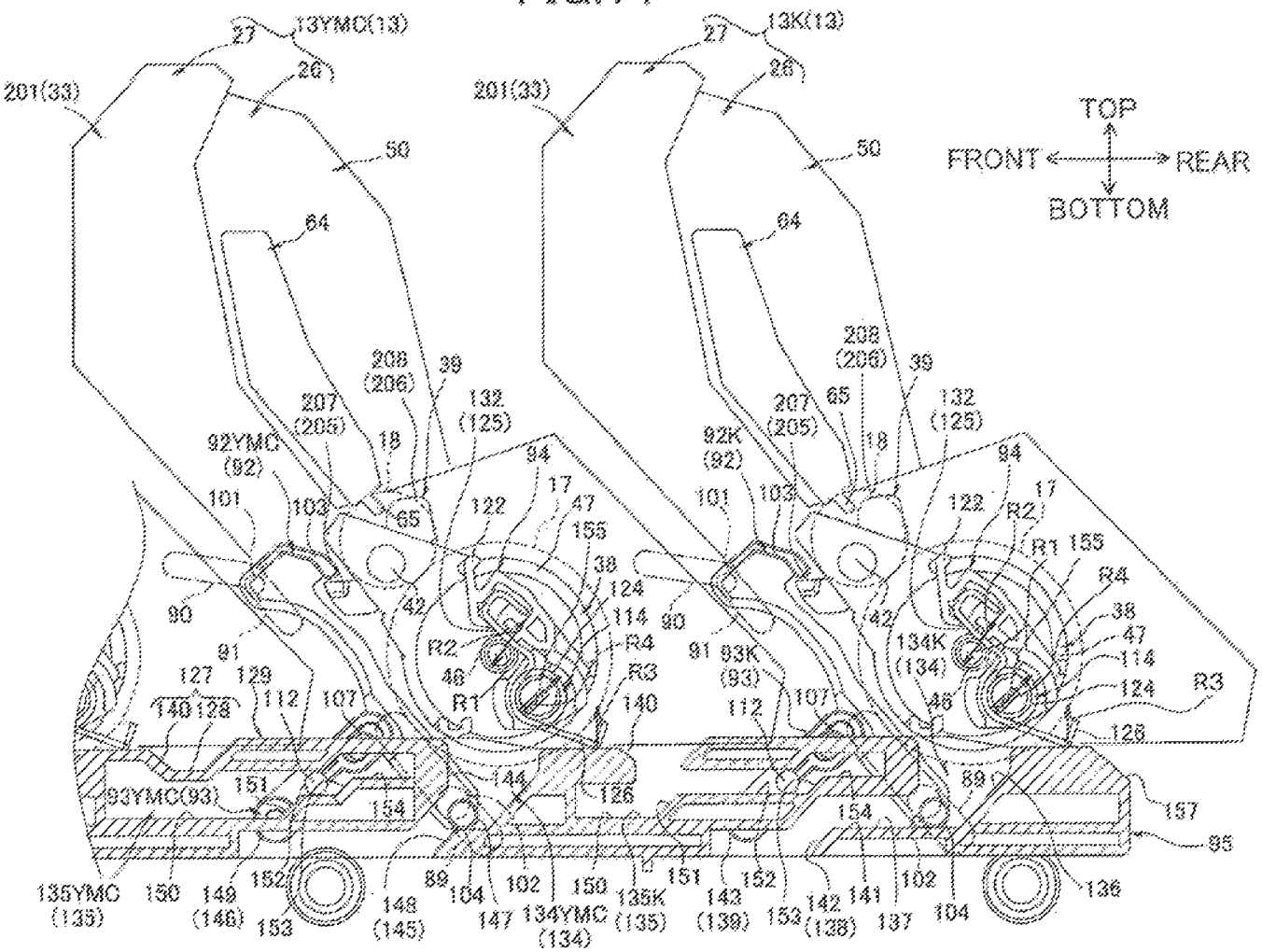
FIG. 14 is a right side view of the black process cartridge, the yellow process cartridge, and the contact/separation locking mechanism when the translation cam is positioned at a multicolor operating position.

In the color mode, the developer-cartridge frames 50 of all process cartridges 13 are disposed in their contact positions, as shown in FIG. 14.

Figure 15:
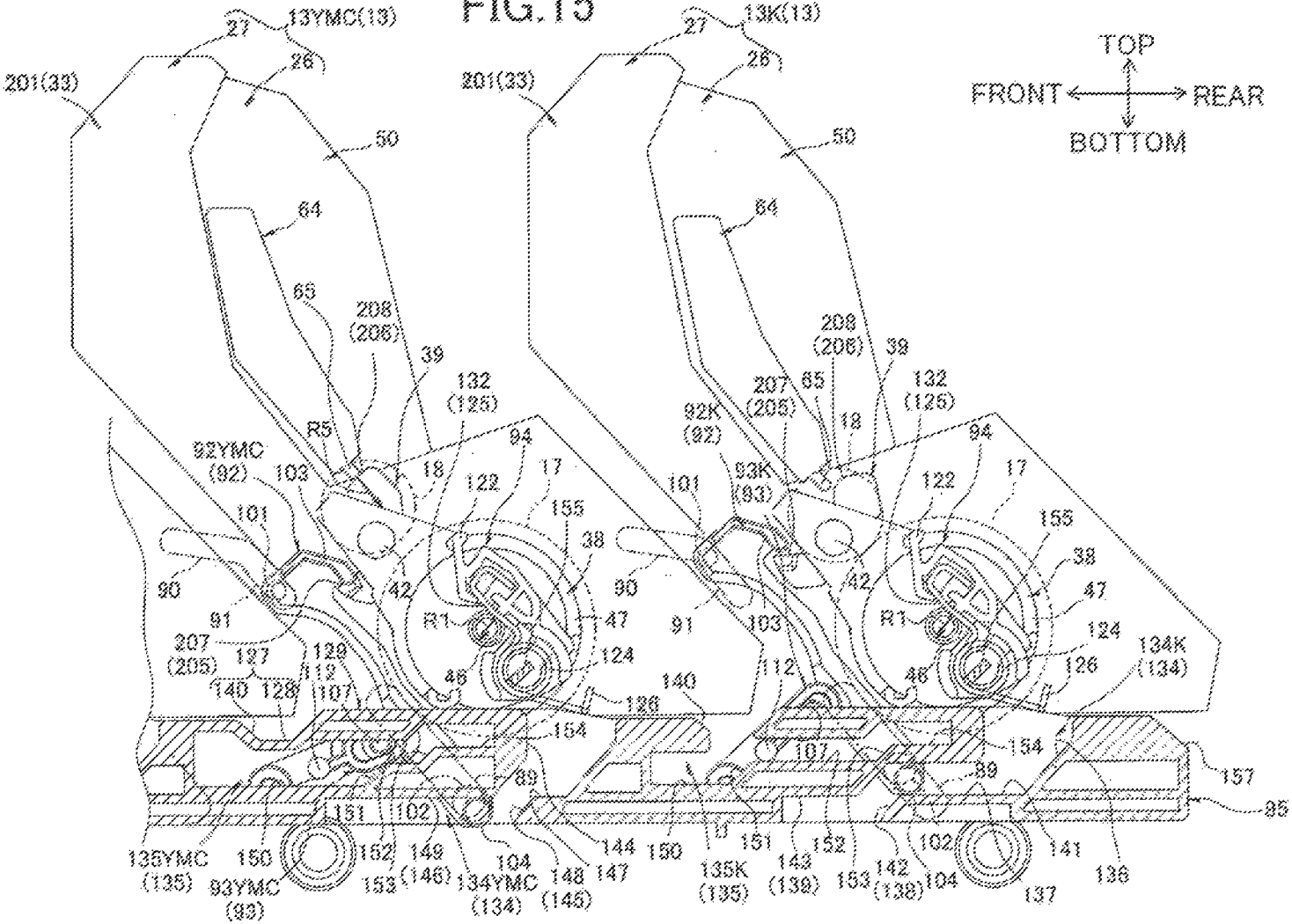
FIG. 15 is a right side view of the black process cartridge, the yellow process cartridge, and the contact/separation locking mechanism when the translation cam is positioned at a monochrome operating position.

In the monochrome mode, only the developer-cartridge frame 50 of the black process cartridge 13K is disposed in its contact position, as shown in FIG. 15. The developer-cartridge frames 50 of the other three process cartridges 13YMC are disposed in their separated positions.

Figure 16:
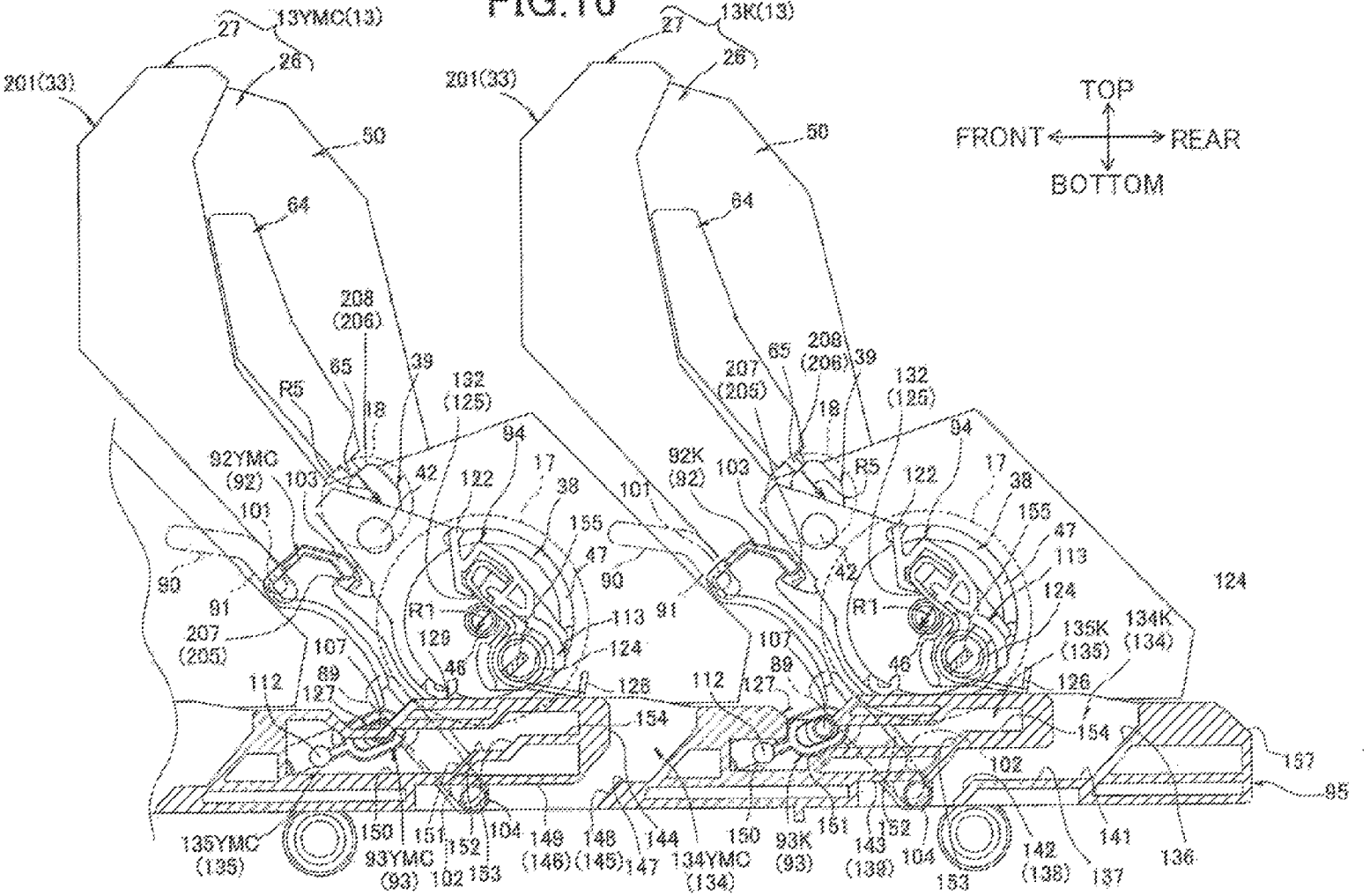
FIG. 16 is a right side view of the black process cartridge, the yellow process cartridge and the contact/separation locking mechanism when the translation cam is positioned at an all-separated position.

In the non-image-forming mode, the developer-cartridge frames 50 of all process cartridges 13 are disposed in their separated positions, as shown in FIG. 16.

On the other hand, while the developer-cartridge frames 50 of all process cartridges 13 are accommodated in the developer-cartridge-accommodating sections 201 of the corresponding drum-cartridge frames 33, as shown in FIG. 13, the pressing members 56 (see FIG. 2) constantly press the developer-cartridge frames 50 into their contact positions. Hence, in order to move the developer-cartridge frames 50 suitably into their contact positions or separated positions, the translation cam 95 is moved rearward from the mounting/removal allowing position (see FIG. 13), moving the contact/separation levers 92 from their retracted positions (see FIG. 13) to their pressure release positions (see FIG. 14) or their pressing positions (see FIG. 16).

In order to move the translation cam 95, a drive force from a motor or other drive source (not shown) provided in the main casing 2 is inputted into the rack gear 130 of the translation cam 95 through a pinion gear (not shown) provided in the main casing 2. This drive force moves the translation cam 95 rearward from the mounting/removal allowing position (see FIG. 13) to one of a multicolor operating position (see FIG. 14), the monochrome operating position (see FIG. 15), and the all-separated position (see FIG. 16), as needed.

(1) Multicolor Operating Position

When a drive force is transmitted to the translation cam 95, the translation cam 95 moves rearward from the mounting/removal allowing position, as illustrated in FIGS. 13 and 14. When the translation cam 95 moves rearward, the second sloped surfaces 153 of all linking-member guide grooves 135 move to a position beneath the engaging bosses 112 of the corresponding linking members 93. Consequently, the engaging bosses 112 of all linking members 93 fall off the corresponding second level support surfaces 154 and move downward along the slope of the second sloped surface 153. As the engaging bosses 112 move downward, the linking members 93 rotate clockwise in a right side view about the corresponding coupling rotational shafts 86 (see FIG. 7B).

At this time, the first bosses 101 are guided by the corresponding retraction guide parts 90 and the second bosses 102 are guided by the corresponding second guide parts 89, causing the contact/separation levers 92 to move in a direction obliquely downward and rearward while rotating clockwise in a right side view about the corresponding second bosses 102. As the translation cam 95 moves further rearward, the engaging bosses 112 of all linking members 93 transfer from the second sloped surfaces 153 to the first level support surfaces 152 and are supported by the first level support surfaces 152 from below, as illustrated in FIG. 14. In this state, rotation of the linking members 93 is restricted.

At this time, the third boss 104 of the black contact/separation lever 92K has arrived at the lower edge defining the retracting groove part 136 of the black lever guide groove 134K and is brought into contact with the support surface 141. Similarly, the third bosses 104 of the three contact/separation levers 92YMC have arrived at the lower edges defining the retracting groove parts 144 of the corresponding three lever guide grooves 134YMC and are brought into contact with the support surfaces 147. Accordingly, the third bosses 104 of all contact/separation levers 92 are supported by the corresponding support surface 141 and support surfaces 147, and all contact/separation levers 92 are disposed in their pressure release positions. Hence, the second sloped surfaces 153 guide the engaging bosses 112 of all linking members 93 so that the contact/separation levers 92 move from their retracted positions to their pressure release positions.

At this time, the pressing part 103 of each contact/separation lever 92 protrudes into the corresponding bearing guide part 73 via the lever insertion hole 81, as shown in FIG. 5. Further, the pressing part 103 confronts the pressure-receiving surface 207 on the lower fin 205 of the separating member 39 from the upper front side thereof and is separated slightly therefrom. In this state, the translation cam 95 is in the multicolor operating position, and the developer-cartridge frames 50 of all process cartridges 13 are disposed in their contact positions, setting the operating mode of the printer 1 to the color mode.

In the color mode, the cam contacting parts 126 of all locking members 94 are in contact with the contact surfaces 129 of the translation cam 95. Note that the cam contacting parts 126 are in contact with the contact surfaces 129, even when the translation cam 95 is in the monochrome operating position or the all-separated position described below.

In other words, when the locking member 94 is in this state, the first portion 132 of the shaft contacting part 125 contacts the shaft 46 from a position above and rearward thereof, and the cam contacting part 126 contacts the contact surface 129 of the translation cam 95 from above. As will be described later, the first portions 132 of all shaft contacting parts 125 push the shaft 46 in a direction diagonally downward and forward with a relative large urging force R1 which is larger than a force when the translation cam 95 is in the mounting/removal allowing position. Consequently, the photosensitive drums 17 are restricted from moving relative to the main casing 2.

Further, as the first portion 132 of the shaft contacting part 125 applies the urging force R1 to the shaft 46 in the direction diagonally downward and forward, a reaction force R2 is applied to the first portion 132 in a direction diagonally upward and rearward, and a reaction force R3 is applied to the cam contacting part 126 in the upward direction since the cam contacting part 126 is pushing the contact surface 129 downward. Consequently, a total force R4 produced by the reaction force R2 and the reaction force R3 is applied to the coil part 124 of the spring member 114 in a direction diagonally upward and rearward through the shaft contacting part 125 and the cam contacting part 126. As a result, the coil part 124 is urged upward and rearward such that its inner peripheral surface contacts the protrusion 155 of the metal plate 96. Hence, the shaft 46 is brought into electrical connection with the metal plate 96 through the spring member 114.

(4) Monochrome Operating Position

When a drive force continues to be transmitted to the translation cam 95, the translation cam 95 moves rearward from the multicolor operating position, as illustrated in FIGS. 14 and 15. As the translation cam 95 moves rearward, the guide surfaces 148 of the three lever guide grooves 134YMC move beneath the third bosses 104 of the corresponding three contact/separation levers 92YMC, and the first sloped surfaces 151 of the three linking-member guide grooves 135YMC move beneath the engaging bosses 112 of the corresponding three linking members 93YMC. Consequently, the third bosses 104 of the three contact/separation levers 92YMC drop off the corresponding support surfaces 147 and move downward along the slopes of the guide surfaces 148, while the engaging bosses 112 of the three linking members 93YMC drop off the corresponding first level support surfaces 152 and move downward along the slopes of the first sloped surfaces 151.

As the engaging bosses 112 move downward, the linking members 93 rotate clockwise in a right side view about the coupling rotational shafts 86 (see FIG. 7B). At this time, the first bosses 101 are guided by the contact/separation guide parts 91 and the second bosses 102 are guided by the second guide parts 89, while the three contact/separation levers 92YMC slide diagonally downward and rearward from their pressure release positions.

As the translation cam 95 moves further rearward, the restriction surfaces 149 of the three lever guide grooves 134YMC move above the third bosses 104 of the corresponding three contact/separation levers 92YMC, and the opposing surfaces 150 of the three linking-member guide grooves 135YMC move beneath the engaging bosses 112 of the corresponding three linking members 93YMC. Consequently, the restriction surfaces 149 apply pressure to the third bosses 104 of the three contact/separation levers 92YMC from above. Further, the engaging bosses 112 of the three linking members 92YMC vertically oppose but are separated from the corresponding opposing surfaces 150. Consequently, the three contact/separation levers 92YMC slide further in a direction downward and rearward into their pressing positions. In other words, the three contact/separation levers 92YMC slide from their pressure release positions to their pressing positions along the mounting direction X.

At this time, the pressing parts 103 of the three contact/separation levers 92YMC apply pressure to the pressure-receiving surfaces 207 on the separating members 39 of the corresponding three process cartridges 13YMC, causing the separating members 39 to rotate counterclockwise in a right side view about their support shafts 42. When the separating members 39 rotate in this direction, the contact surfaces 208 of the separating members 39 contact the rear surfaces of the separation contact parts 65 (separation contact parts 58) in a direction diagonally upward and forward. As a result, the developer cartridges 27 of the corresponding three process cartridges 13YMC move diagonally upward and forward against the pressing three of the pressing members 56 into their separated positions. Note that the black contact/separation lever 92K remains in the pressure release position at this time. Hence, only the developer-cartridge frame 50 of the black process cartridge 13K is disposed in its contact position, while the developer-cartridge frames 50 of the three process cartridges 13YMC are disposed in their separated positions. Through this process, the translation cam 95 is disposed in the monochrome operating position, thereby setting the operating mode of the printer 1 to the monochrome mode.

Further, as each separating member 39 pushes the corresponding separation contact part 65 (separation contact part 58) in a direction obliquely upward and forward, a reaction force R5 is exerted on the separating member 39 in a direction obliquely downward and rearward, as illustrated in FIG. 15. The reaction force R5 acts on the support shaft 42 through the separating member 39, and in turn on the drum-cartridge frame 33. Hence, the reaction force R5 urges the shaft-receiving part 47 of the bearing member 38 in a direction obliquely downward and rearward, as will be described later.

(3) All-Separated Position

When a drive force is further transmitted to the translation cam 95, the translation cam 95 moves further rearward from the monochrome operating position, as illustrated in FIGS. 15 and 16. As the translation cam 95 moves rearward, the guide surface 142 on the black lever guide groove 134K moves beneath the third boss 104 on the black contact/separation lever 92K, and the first sloped surface 151 of the black linking-member guide groove 135K moves beneath the engaging boss 112 of the black linking member 93K. Consequently, the third boss 104 of the black contact/separation lever 92K drops off the corresponding support surface 141 and moves downward along the slope of the guide surface 142. At the same time, the engaging boss 112 on the black linking member 93K drops off the corresponding first level support surface 152 and moves downward along the slope of the first sloped surface 151. As both the third boss 104 and the engaging boss 112 move downward, the black contact/separation lever 92K slides in a direction obliquely downward and rearward from the pressure release position.

As the translation cam 95 moves further rearward, the restriction surface 143 of the black lever guide groove 134K arrives above the third boss 104 of the black contact/separation lever 92K, and the opposing surface 150 of the black linking-member guide groove 135K moves beneath the engaging boss 112 of the black linking member 93K. Consequently, the third boss 104 of the black contact/separation lever 92K is pushed from above by the restriction surface 143. In addition, the engaging boss 112 of the black linking member 93K vertically opposes but is separated from the corresponding opposing surface 150. As a result, the black contact/separation lever 92K continues to slide in a direction diagonally downward and rearward from its pressing position.

As with the three contact/separation levers 92YMC described above, the black contact/separation lever 92K presses against the separating member 39, causing the separating member 39 to push the separation contact part 65 (separation contact part 58) obliquely upward and forward. As a result, the developer cartridge 27 corresponding to the black process cartridge 13K is pushed into its separated position against the force of the pressing members 56. Thus, all developer cartridges 27 are disposed in their separated positions at this time.

Through the above process, the translation cam 95 is disposed in the all-separated position, setting the operating mode of the printer 1 to the non-image-forming mode.

Further, when the separating member 39 presses the separation contact part 65 (separation contact part 58) obliquely upward and forward, the reaction force R5 acting in a direction obliquely downward and rearward is applied to the separating member 39, as illustrated in FIG. 11. As described above, the reaction force R5 urges the shaft-receiving part 47 of the bearing member 38 in a direction downward and rearward, urging the flange member 44 through the shaft-receiving part 47 of the bearing member 38 toward the reaction-force receiving surface 79 of the positioning protrusion 77. In other words, the reaction-force receiving surface 79 is disposed downstream of the flange member 44 with respect to the direction in which the reaction force R5 acts (a reaction force direction Y shown in FIG. 11).

As described above, the first portion 132 of the shaft contacting part 125 presses a corresponding shaft 46 in a direction diagonally downward and forward with the urging force R1. Hence, the shaft contacting part 125 presses the right flange member 44 through the shaft 46, urging the right flange member 44 toward the urging-force receiving surface 78 on the rear positioning protrusion 77. Thus, the urging-force receiving surface 78 is disposed downstream of the right flange member 44 with respect to the direction in which the urging force R1 of the shaft contacting part 125 is applied (an urging direction Z shown in FIG. 11). Here, the reaction force direction Y and the urging direction Z are approximately orthogonal to each other. Specifically, an angle θ formed by an imaginary line extending in the reaction force direction Y and an imaginary line extending in the urging direction Z when viewed in the left-right direction is between 82 and 90 degrees. In addition, the spring member 114 is configured such that the urging force R1 is smaller than the reaction force R5.

According to the operations described above, the operating mode of the printer 1 can be switched suitably among the color mode, the monochrome mode, and the non-image-forming mode.

6. Operational Advantages (1) As shown in FIG. 14, the urging-force receiving surface 78 of the positioning protrusion 77 is disposed downstream of the urging direction Z of the force applied by the shaft contacting part 125 of the locking member 94 with respect to the right flange member 44 (the right axial end of the photosensitive drum 17). Accordingly, the urging force R1 of the shaft contacting part 125 urges the right flange member 44 toward the urging-force receiving surface 78 through the shaft 46.

Since the separating member 39 is provided on the drum-cartridge frame 33, the reaction force R5, produced when the separating member 39 applies a force to the separation contact part 58 of the developer-cartridge frame 50, acts on the drum-cartridge frame 33 through the support shaft 42. Since the reaction-force receiving surface 79 is disposed downstream of the reaction force direction Y with respect to the flange member 44 (an axial end of the photosensitive drum 17), the reaction force R5 urges the flange member 44 toward the reaction-force receiving surface 79 through the shaft-receiving part 47 of the bearing member 38 provided on the drum-cartridge frame 33.

Hence, the urging force R1 applied by the shaft contacting part 125 of the locking member 94 and the reaction force R5 produced when the developer-cartridge frame 50 is in the separated position (when the developing roller 18 is separated from the photosensitive drum 17) urge the right flange member 44 toward the urging-force receiving surface 78 and the reaction-force receiving surface 79, respectively, which slope in different directions from each other. Through this configuration, the right flange member 44 is supported on the urging-force receiving surface 78 and the reaction-force receiving surface 79 through the shaft-receiving part 47 and is thereby positioned relative to the positioning protrusions 77 of the main side wall 70. The same is true with respect to the left flange member 44. Therefore, this construction can maintain the position of the photosensitive drum 17 relative to the main casing 2 constant, even when the developer-cartridge frame 50 is moved between the contact position and the separated position. Thus, the relative positions of the photosensitive drums 17 and the main casing 2 can be maintained constant while the developing roller 18 contacts and separates from the photosensitive drum 17.

(2) As shown in FIG. 11, the urging direction Z and the reaction force direction Y are approximately orthogonal to each other. Accordingly, the right flange member 44 is pressed in substantially orthogonal directions by the respective urging force R1 and the reaction force R5 and in thereby supported on the urging-force receiving surface 78 and the reaction-force receiving surface 79 through the shaft-receiving part 47.

Hence, the right flange member 44 can be reliably positioned relative to the positioning protrusions 77 of the main side wall 70. Thus, the relative positions of the photosensitive drums 17 and the main casing 2 can be reliably maintained constant while the developing roller 18 contacts and separates from the photosensitive drum 17.

(3) The urging force R1 applied by the shaft contacting part 125 of the spring member 114 is set smaller than the reaction force R5. That is, the reaction force R5 is relatively larger, and a reaction force of R5 is exerted on the developer-cartridge frame 50 so as to move the developer-cartridge frame 50 diagonally upward and forward. Accordingly, the developer-cartridge frame 50 can be reliably set to the contact position and the separated position, enabling the developing roller 18 to be reliably placed in contact with and separated from the corresponding photosensitive drum 17.

(4) The locking member 94 is also provided with the spring member 114. As shown in FIG. 12, the spring member 114 is in electrical contact with the shaft 46 of the photosensitive drum 17 when the process cartridge 13 is mounted in the main casing 2. In this way, the spring member 114 can be configured as a grounding part. Hence, the photosensitive drum 17 can be grounded through the shaft 46 and the spring member 114 while the shaft contacting part 125 of the spring member 114 urges the right flange member 44 toward the urging-force receiving surface 78 through the shaft 46. This construction can reduce the number of required parts by not providing a separate member as a grounding part.

(5) As shown in FIG. 11, the spring member 114 is a torsion coil spring. Hence, through a simple structure, the right flange member 44 can be reliably urged toward the urging-force receiving surface 78 of the positioning protrusion 77 through the shaft 46, and the spring member 114 can be reliably connected electrically to the photosensitive drum 17.

(6) As shown in FIG. 11, the spring retaining member 113 is provided to cover the spring member 114. Hence, the spring member 114 and other conductive components supported on the main casing 2 (electrodes, for example) can be electrically insulated.

(7) The contact/separation lever 92 is slidingly moved between a pressing position (see FIG. 16) for applying pressure to the separating member 37, and a pressure release position (see FIG. 14) for opposing the separating member 39 with a distance.

When the contact/separation lever 92 is in the pressing position shown in FIG. 16, the pressing part 103 of the contact/separation lever 92 presses the pressure-receiving surface 207 on the separating member 39. As a result of this pressure, the separating member 39 rotates counterclockwise in a right side view about the support shaft 42 and applies pressure to the separation contact part 65 (separation contact part 58) of the developer-cartridge frame 50 for moving the developer-cartridge frame 50 into its separated position.

Then, when the contact/separation lever 92 is in the pressure release position shown in FIG. 14, the pressing part 103 of the contact/separation lever 92 confronts the pressure-receiving surface 207 of the separating member 39 but is separated therefrom. Consequently, the developer-cartridge frame 50 is in its contact position.

In this way, the developer-cartridge frame 50 can be more reliably moved between its contact position and the separated position.

(8) As shows in FIGS. 14-16, the contact/separation lever 92 slidingly moves along the mounting direction X between the pressing position and the pressure release position. This movement prevents the contact/separation lever 92 from crossing the path of the process cartridge 13 in comparison with a case where the contact/separation lever 92 rotatably or pivotally moves. Thus, this configuration prevents the process cartridge 13 from contacting the contact/separation lever 92 when the process cartridge 13 is mounted in or removed from the main casing 2. This facilitates smooth operations for mounting and removing the process cartridges 13 relative to the main casing 2.

(9) As shown in FIG. 17, the contact/separation lever 92 is configured to move to a retracted position in order to be retracted from the locus of the process cartridge 13. If the contact/separation lever 92 is in its retracted position, contact between the process cartridge 13 and the contact/separation lever 92 can be reliably prevented when mounting the process cartridge 13 in or removing the process cartridge 13 from the main casing 2. Thus, this construction ensures smooth operations for mounting and removing the process cartridges 13 relative to the main casing 2.

(10) If the translation cam 95 is placed in the all-separated position shown in FIG. 11, the shaft contacting part 125 urges the flange member 44 toward the urging-force receiving surface 714 via the shaft 46 with a relatively large urging force R1. Hence, this configuration improves the precision in positioning the photosensitive drums 17 relative to the main casing 2.

On the other hand, when removing the process cartridge 13 from the main casing 2, the force applied by the shaft contacting part 125 to the shaft 46 can be reduced by placing the translation cam 95 in the mounting/removal allowing position shown in FIG. 12. This configuration can more reliably ensure smooth operations for mounting and removing the process cartridges 13 relative to the main casing 2. Therefore, the printer 1 according to the preferred embodiment can reliably ensure smooth operations for mounting the process cartridges 13 in and removing the process cartridges 13 from the main casing 2 while improving the precision in positioning photosensitive drama 17 relative to the main casing 2 for image formation.

(11) When the translation cam 95 is disposed in the all-separated position shown in FIG. 11, the cam contacting parts 126 of the spring members 114 are in contact with the contact surface 129 on the translation cam 95. In this way, the shaft contacting part 125 reliably urges the flange member 44 toward the urging-force receiving surface 78 through the shaft 44.

Further, when the translation cam 95 is disposed in the mounting/removal allowing position shown in FIG. 13, the cam contacting parts 126 of the spring members 114 are separated from the contact surface 129 on the translation cam 95. Accordingly, the urging force R1 applied by the shaft contacting parts 125 to the shafts 46 is reliably reduced from that applied when the translation cam 95 is in the all-separated position.

(12) When the translation cam 95 is in the mounting/removal allowing position, the engaging parts 123 of the spring retaining members 113 contact (engage with) the corresponding engaging grooves 84 in the drum-support frame 72, as shown in FIG. 6. Therefore, the locking members 94 are prevented from dropping out of (moving from) their prescribed positions. Accordingly, the extension part 122 and the shaft contacting part 125 of each locking member 94 can be positioned so as not to interfere with the process cartridge 13 when the process cartridge 13 is mounted in or removed from the main casing 2. Thus, this construction more reliably ensures smooth operations for mounting and removing the process cartridges 13 relative to the main casing 2.

(13) Since the linking member 93 couples the corresponding contact/separation lever 92 to the translation cam 95, as illustrated in FIG. 12, changes in the force applied by the shaft contacting part 125 to the shaft 46 can be associated with movement of the contact/separation lever 92. Hence, in comparison with a configuration having a structure for moving the contact/separation lever 92 and a separate structure for changing the urging force of the shaft contacting part 125, this structure for both moving the contact/separation lever 92 and adjusting the urging force of the shaft contacting part 125 can be made more compact, thereby simplifying and reducing the size of the image-forming apparatus.

When viewed in the left-right direction, as shown in FIG. 7B, the engaging boss 112 of the linking member 93 is positioned between the coupling-boss insertion hole 108, which is rotatably engaged with the contact/separation lever 92, and the rotational-shaft insertion hole 109, which is rotatably fixed on the main casing 2. This configuration can ensure that the movement of the contact/separation lever 92 in response to movement of the translation cam 95 is greater than that of the translation cam 95. As a result, the contact/separation lever 92 can be moved reliably between the pressing position and the pressure release position while conserving space within the printer 1.

(14) When the translation cam 95 is moved from its mounting/removal allowing position to the multicolor operating position, as illustrated in FIGS. 13 and 14, the engaging bosses 112 of the linking members 93 are guided along the corresponding second sloped surfaces 153 of the translation cam 95 in order to move the contact/separation levers 92 from their retracted positions to their pressure release positions. By moving the translation cam 95 from the mounting/removal allowing position to the multicolor operating position, the contact/separation levers 92 can be moved to their pressure release positions while relatively increasing the urging force R1 that the shaft contacting parts 125 of the locking members 94 apply to the corresponding shafts 46. Hence, this construction further improves the precision in positioning the photosensitive drums 17 relative to the main casing 2 for an image-forming operation (in the color mode).

7. Variations of the Embodiment

The printer 1 described in the preferred embodiment is one example of an image-forming apparatus according to the present invention, but the present invention is not limited to the embodiment. In addition to the direct tandem-type color printer described in the embodiment, the image-forming apparatus of the present invention may be configured as an intermediate transfer tandem-type color printer having a plurality of photosensitive bodies, an intermediate transfer body, and a transfer member. The image-forming apparatus of the present invention may also be configured as a monochrome printer having a single process cartridge 13.

Further, instead of configuring the process cartridge 13 as a separable structure in which the drum cartridge 26 can be separated from the developer cartridge 27, the process cartridge 13 may be configured as an integrated structure that integrally provides the drum cartridge 26 with the developer cartridge 27.

Further, the developed cartridge 27 may be provided with a toner cartridge for accommodating toner and may be configured such that the toner cartridge is detachably mounted in a frame that retains the developing roller 18.

Further, the separating members 39 may be provided at the drum frame 33 or may be provided at the casing 2 side.

The above variations of the embodiment can achieve the same operational advantages described in the embodiment. The present invention may also be applied to any combinations of the embodiment and the variations described above.

What is claimed is:

1. An image forming apparatus comprising:

a cartridge including:

a photosensitive drum configured to rotate about an axis line extending in an axial direction and having an end portion in the axial direction;

a developing roller disposed in confrontation with the photosensitive drum;

a developing frame rotatably supporting the developing roller and movable between a contact position where the photosensitive drum contacts the developing roller and a separated position where the photosensitive drum is separated from the developing roller; and a drum frame supporting the photosensitive drum, the drum frame having a separating member configured to act on the developing frame so as to dispose the developing frame at the separated position, the separating member acting on the developing frame, so that a reaction force is exerted on the separating member in a reaction force direction; and a casing configured to detachably receive the cartridge, the casing including:

a positioning member configured to position the end portion of the photosensitive drum, the positioning member having a first surface and a second surface extending in a direction different from that of the first surface, an urging member configured to urge the end portion of the photosensitive drum toward the positioning member in an urging direction; and a separation pressing member configured to press the separating member so as to let the separating member act on the developing frame, wherein the first surface is configured to support the end portion of the photosensitive drum at a position downstream of the urging direction, wherein the second surface is configured to support the end portion of the photosensitive drum at a position downstream of the reaction force direction, and wherein the urging member includes a conductive member made of conductive material, the conductive member being configured to contact the end portion of the photosensitive drum so as to be in electrical connection with the photosensitive drum.

2. The image forming apparatus according to claim 1, wherein the first surface and the second surface are symmetrical to each other relative to a symmetrical axis extending vertically and passing the axis line as viewed from the axial direction.

3. The image forming apparatus according to claim 1, wherein the urging direction is orthogonal to the reaction force direction.

4. The image forming apparatus according to claim 1, wherein an urging force with which the urging member urges the end portion of the photosensitive drum is smaller than the reaction force.

5. The image forming apparatus according to claim 1, wherein the urging member is a torsion coil spring.

6. The image forming apparatus according to claim 1, wherein the urging member further includes a covering member made of insulation material for covering the conductive member.

7. The image forming apparatus according to claim 1, wherein the separation pressing member is slidingly movable between a pressing position for pressing the separating member and a pressure release position for facing the separating member with a gap therebetween.

8. The image forming apparatus according to claim 7, wherein the separation pressing member is slidingly movable along a mounting direction in which the cartridge is detachably mounted to the casing.

9. The image forming apparatus according to claim 8, wherein the separation pressing member is movable at a retracted position retracted from a mounting/removal locus of the cartridge.

10. The image forming apparatus according to claim 1, wherein the casing further includes a reciprocation member being slidingly movable between a first position and a second position, and wherein the urging member is configured to urge the end portion of the photosensitive drum with a first urging force toward the first surface when the reciprocation member is at the first position, the urging member urging the end portion of the photosensitive drum with a second urging force smaller than the first urging force toward the first surface when the reciprocation member is at the second position.

11. The image forming apparatus according to claim 10, wherein the reciprocation member includes a first facing surface and a second facing surface opposed to the urging member with respect to the first facing surface, and wherein the urging member faces and contacts the first facing surface when the reciprocation member is at the first position, the urging member facing the second facing surface when the reciprocation member is at the second position.

12. The image forming apparatus according to claim 10, wherein the urging member includes an engaging part, the engaging part engaging the casing when the reciprocation member is at the second position.

13. The image forming apparatus according to claim 10, wherein the casing further includes a connection member connecting the separation pressing member with the reciprocation member, wherein the connection member includes a first connecting part rotatably engaged with the separation pressing member, a second connecting part rotatably fixed to the casing, and a third connecting part movably engaged with the reciprocation member and disposed between the first connecting part and the second connecting part.

14. The image forming apparatus according to claim 13, wherein the reciprocation member has a leading surface for leading the third connecting part such that the separation pressing member moves from a retracted position retracted from a mounting/removal locus of the cartridge to a pressure release position facing the separating member with a gap therebetween when the reciprocation member is moved from the second position to the first position.

15. An image forming apparatus comprising:

a cartridge including:

a photosensitive drum configured to rotate about an axis line extending in an axial direction and having an end portion in the axial direction;

a developing roller disposed in confrontation with the photosensitive drum;

a developing frame rotatably supporting the developing roller and movable between a contact position where the photosensitive drum contacts the developing roller and a separated position where the photosensitive drum is separated from the developing roller; and a drum frame supporting the photosensitive drum, the drum frame having a separating member configured to act on the developing frame so as to dispose the developing frame at the separated position, the separating member acting on the developing frame, so that a reaction force is exerted on the separating member in a reaction force direction; and a casing configured to detachably receive the cartridge, the casing including:

a positioning member configured to position the end portion of the photosensitive drum, the positioning member having a first surface and a second surface extending in a direction different from that of the first surface, an urging member configured to urge the end portion of the photosensitive drum toward the positioning member in an urging direction; and a separation pressing member configured to press the separating member so as to let the separating member act on the developing frame, wherein the first surface is configured to support the end portion of the photosensitive drum at a position downstream of the urging direction, wherein the second surface is configured to support the end portion of the photosensitive drum at a position downstream of the reaction force direction, wherein the separation pressing member is slidingly movable between a pressing position for pressing the separating member and a pressure release position for facing the separating member with a gap therebetween, and wherein the separation pressing member is slidingly movable along a mounting direction in which the cartridge is detachably mounted to the casing.

16. The image forming apparatus according to claim 15, wherein the separation pressing member is movable at a retracted position retracted from a mounting/removal locus of the cartridge.

17. An image forming apparatus comprising:

a cartridge including:

a photosensitive drum configured to rotate about an axis line extending in an axial direction and having an end portion in the axial direction;

a developing roller disposed in confrontation with the photosensitive drum;

a developing frame rotatably supporting the developing roller and movable between a contact position where the photosensitive drum contacts the developing roller and a separated position where the photosensitive drum is separated from the developing roller; and a drum frame supporting the photosensitive drum, the drum frame having a separating member configured to act on the developing frame so as to dispose the developing frame at the separated position, the separating member acting on the developing frame, so that a reaction force is exerted on the separating member in a reaction force direction; and a casing configured to detachably receive the cartridge, the casing including:

a positioning member configured to position the end portion of the photosensitive drum, the positioning member having a first surface and a second surface extending in a direction different from that of the first surface, an urging member configured to urge the end portion of the photosensitive drum toward the positioning member in an urging direction; and a separation pressing member configured to press the separating member so as to let the separating member act on the developing frame, wherein the first surface is configured to support the end portion of the photosensitive drum at a position downstream of the urging direction, wherein the second surface is configured to support the end portion of the photosensitive drum at a position downstream of the reaction force direction, wherein the casing further includes a reciprocation member being slidingly movable between a first position and a second position, wherein the urging member is configured to urge the end portion of the photosensitive drum with a first urging force toward the first surface when the reciprocation member is at the first position, the urging member urging the end portion of the photosensitive drum with a second urging force smaller than the first urging force toward the first surface when the reciprocation member is at the second position, wherein the casing further includes a connection member connecting the separation pressing member with the reciprocation member, and wherein the connection member includes a first connecting part rotatably engaged with the separation pressing member, a second connecting part rotatably fixed to the casing, and a third connecting part movably engaged with the reciprocation member and disposed between the first connecting part and the second connecting part.

18. The image forming apparatus according to claim 17, wherein the reciprocation member has a leading surface for leading the third connecting part such that the separation pressing member moves from a retracted position retracted from a mounting/removal locus of the cartridge to a pressure release position facing the separating member with a gap therebetween when the reciprocation member is moved from the second position to the first position.

* * * * *